US011723131B2

(12) United States Patent
Hashimoto

(10) Patent No.: US 11,723,131 B2
(45) Date of Patent: Aug. 8, 2023

(54) DISPLAY DEVICE

(71) Applicant: Innolux Corporation, Miao-Li County (TW)

(72) Inventor: Kazuyuki Hashimoto, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/540,250

(22) Filed: Dec. 2, 2021

(65) Prior Publication Data

US 2022/0330401 A1 Oct. 13, 2022

Related U.S. Application Data

(60) Provisional application No. 63/172,719, filed on Apr. 9, 2021.

(51) Int. Cl.

| | |
|---|---|
| ***G09G 3/32*** | (2016.01) |
| ***G09G 3/3233*** | (2016.01) |
| ***H05B 45/30*** | (2020.01) |
| ***H05B 45/325*** | (2020.01) |
| ***H05B 45/39*** | (2020.01) |

(52) U.S. Cl.

CPC ..... *H05B 45/325* (2020.01); *H05B 45/39* (2020.01)

(58) Field of Classification Search

CPC ..... H05B 45/30; H05B 45/325; H05B 45/39; G09G 3/32; G09G 3/3233; G09G 3/3258; G09G 3/34

See application file for complete search history.

(56) References Cited

U.S. PATENT DOCUMENTS

| | | | | |
|---|---|---|---|---|
| 10,455,653 | B1 * | 10/2019 | Watanabe | G09G 3/32 |
| 2018/0130411 | A1 * | 5/2018 | Zhou | G09G 3/3225 |
| 2020/0051499 | A1 * | 2/2020 | Chung | G09G 3/3266 |
| 2022/0101780 | A1 * | 3/2022 | Xiao | G09G 3/3233 |

FOREIGN PATENT DOCUMENTS

| | | |
|---|---|---|
| CN | 109584788 | 4/2019 |

OTHER PUBLICATIONS

"Office Action of Taiwan Counterpart Application", dated Feb. 17, 2023, p. 1-p. 5.

* cited by examiner

*Primary Examiner* — Thai Pham
(74) *Attorney, Agent, or Firm* — JCIPRNET

(57) ABSTRACT

A display device is provided. The display device of the disclosure includes a light emitting unit, a current source, a voltage comparator, and an emission control unit. The current source is configured to output a supply current. The voltage comparator is configured to receive a voltage data and a ramp signal. The emission control unit receives an emission enable signal, and coupled to the light emitting unit, the current source, and the voltage comparator. The voltage comparator outputs a comparison signal to the emission control unit according to the voltage data and the ramp signal. The emission control unit outputs a driving current to the light emitting unit according to the supply current, the emission enable signal, and the comparison signal.

20 Claims, 13 Drawing Sheets

DISPLAY DEVICE

CROSS-REFERENCE TO RELATED APPLICATION

This application claims the priority benefits of U.S. provisional application Ser. No. 63/172,719, filed on Apr. 9, 2021. The entirety of the above-mentioned patent application is hereby incorporated by reference herein and made a part of this specification.

BACKGROUND

Technical Field

The disclosure relates a device; particularly, the disclosure relates to a display device.

Description of Related Art

For a general display device, since the every pixels of the general display device may perform the data setup operation at the same time, so that the general display device has the problem of the on-peak power consumption, in particular, the occurrence of IR-drop and no light at the moment when the camera is photographed. Moreover, the general display device with high pixels per inch (PPI) panel also has the disadvantage of too large circuit area.

SUMMARY

The display device of the disclosure includes a light emitting unit, a current source, a voltage comparator, and an emission control unit. The current source is configured to output a supply current. The voltage comparator is configured to receive a voltage data and a ramp signal. The emission control unit is configured to receive an emission enable signal and is coupled to the light emitting unit, the current source, and the voltage comparator. The voltage comparator outputs a comparison signal to the emission control unit according to the voltage data and the ramp signal. The emission control unit outputs a driving current to the light emitting unit according to the supply current and the comparison signal.

The display device of the disclosure includes a pixel array. The pixel array includes a plurality of pixel units. The plurality of pixel units are divided into a plurality of pixel groups. The plurality of pixel groups respectively receive a plurality of emission enable signals, a plurality of voltage data, and a common ramp signal. The plurality of pixel groups are lighted up during a plurality of emission periods and setup during a plurality of data setup periods according to the plurality of emission enable signals, the plurality of voltage data, and the common ramp signal respectively. The plurality of data setup periods respectively corresponding to the plurality of pixel groups are non-overlapping with each other in time.

Based on the above, according to the display device of the disclosure, the display device can provide good display effect.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
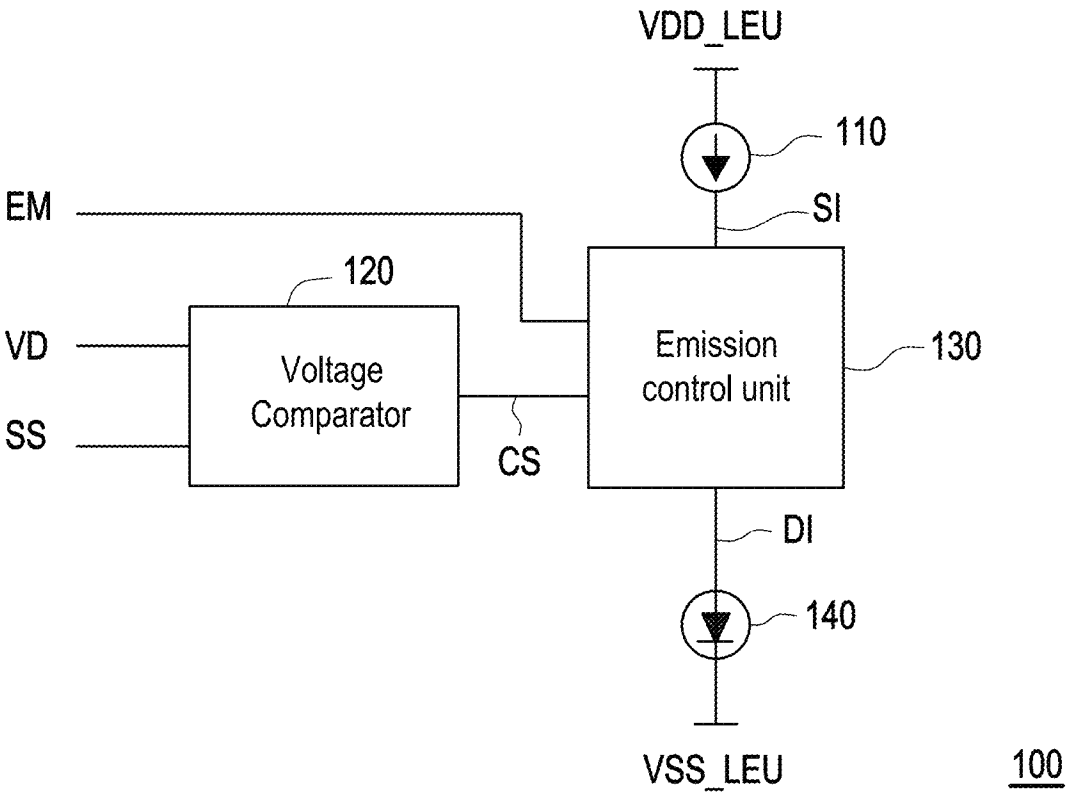
FIG. 1 is a schematic diagram of a display device according to an embodiment of the disclosure.

Reference will now be made in detail to the exemplary embodiments of the disclosure, examples of which are illustrated in the accompanying drawings. Whenever possible, the same reference numbers are used in the drawings and the description to refer to the same or like components.

Certain terms are used throughout the specification and appended claims of the disclosure to refer to specific components. Those skilled in the art should understand that electronic device manufacturers may refer to the same components by different names. This article does not intend to distinguish those components with the same function but different names. In the following description and rights request, the words such as "comprise" and "include" are open-ended terms, and should be explained as "including but not limited to . . . ".

The term "coupling (or connection)" used throughout the whole specification of the present application (including the appended claims) may refer to any direct or indirect connection means. For example, if the text describes that a first device is coupled (or connected) to a second device, it should be interpreted that the first device may be directly connected to the second device, or the first device may be indirectly connected through other devices or certain connection means to be connected to the second device. The terms "first", "second", and similar terms mentioned throughout the whole specification of the present application (including the appended claims) are merely used to name discrete elements or to differentiate among different embodiments or ranges. Therefore, the terms should not be regarded as limiting an upper limit or a lower limit of the quantity of the elements and should not be used to limit the arrangement sequence of elements. In addition, wherever possible, elements/components/steps using the same reference numerals in the drawings and the embodiments represent the same or similar parts. Reference may be mutually made to related descriptions of elements/components/steps using the same reference numerals or using the same terms in different embodiments.

The display device of the disclosure may be an active matrix light emitting diode (AM-LED) display device, but the disclosure is not limited thereto. In some embodiment of the disclosure, the display device of the disclosure may, for example, be adapted to a liquid crystal, a light emitting diode, a quantum dot (QD), a fluorescence, a phosphor, other suitable display medium, or the combination of the aforementioned material, but the disclosure is not limited thereto. The light emitting diode may include, for example, organic light emitting diode (OLED), sub-millimeter light emitting diode (Mini LED), micro light emitting diode (Micro LED), or quantum dot light emitting diode (QLED or QDLED) or other suitable materials. The materials may be arranged and combined arbitrarily, but the disclosure is not limited to thereto. The display device of the disclosure may include peripheral systems such as driving system, control system, light source system, shelf system, and the like to support the light emitting device.

It should be noted that in the following embodiments, the technical features of several different embodiments may be replaced, recombined, and mixed without departing from the spirit of the disclosure to complete other embodiments. As long as the features of each embodiment do not violate the spirit of the disclosure or conflict with each other, they may be mixed and used together arbitrarily.

FIG. 1 is a schematic diagram of a display device according to an embodiment of the disclosure. Referring to FIG. 1, the display device 100 includes a pixel array, and the pixel array includes a plurality of pixel units, wherein each of the plurality of pixel units may include the circuit architecture as shown in FIG. 1. In the embodiment of the disclosure, the display device 100 includes a current source 110, a voltage comparator 120, an emission control unit 130 and a light emitting unit 140. The current source 110 is coupled between an operation voltage VDD_LEU and the emission control unit 130. The emission control unit 130 is further coupled to the voltage comparator 120 and the light emitting unit 140, and receives an emission enable signal EM. The light emitting unit 140 is coupled between the emission control unit 130 and a voltage VSS_LEU. The voltage VSS_LEU is lower than the operation voltage VDD_LEU. In the embodiment of the disclosure, the current source 110 is configured to output a supply current SI to the emission control unit 130. The voltage comparator 120 is configured to receive a voltage data VD and a ramp signal SS. The voltage comparator 120 outputs a comparison signal CS to the emission control unit 130 according to the voltage data VD and the ramp signal SS, and the emission control unit 130 outputs a driving current DI to the light emitting unit 140 according to the supply current SI, the emission enable signal EM, and the comparison signal CS. In the embodiment of the disclosure, the emission enable signal EM, the voltage data VD, and the ramp signal SS may be provided from multiple driving circuits respectively arranged out of a plane of the display device 100 or arranged inside the plane of the display device 100 through a data line and/or a scan line.

Figure 2:
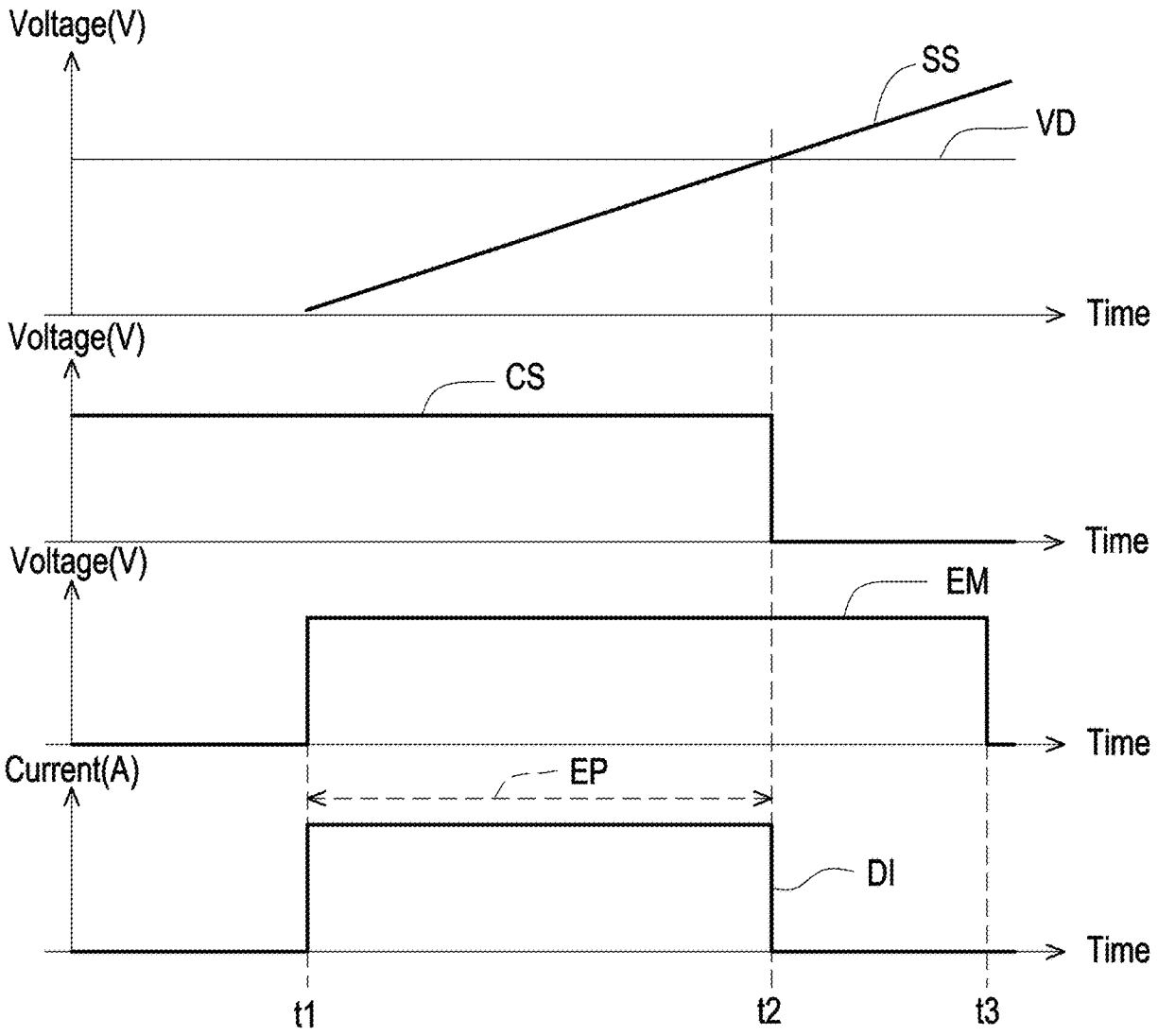
FIG. 2 is a schematic diagram of signals according to the embodiment of FIG. 1 of the disclosure.

FIG. 2 is a schematic diagram of signals according to the embodiment of FIG. 1 of the disclosure. Referring to FIG. 1 and FIG. 2, the voltage comparator 120 may receive the voltage data VD and the ramp signal SS. At time t1, the voltage of the ramp signal SS starts to rise to form a ramp waveform. Due to the voltage of the ramp signal SS is lower than the voltage of voltage data VD, the voltage comparator 120 outputs the comparison signal CS having a high voltage level. During an enable period from time t1 to time t3, the emission control unit 130 receives the emission enable signal EM having the high voltage level. After time t2, due to the voltage of the ramp signal SS is higher than the voltage of voltage data VD, the voltage comparator 120 outputs the comparison signal CS having a low voltage level. Thus, during an emission period EP from time t1 to time t2, the emission control unit 130 outputs the driving current DI to drive the light emitting unit 140.

In the embodiment of the disclosure, the voltage comparator 120 may further receive a pulse-width modulation (PWM) scan signal, and perform voltage programming on the voltage data VD according to the pulse-width modulation scan signal. The display device 100 may determine the emission period EP by controlling the voltage level of the voltage data VD. If the voltage level of the voltage data VD is higher, the time length of the emission period EP is longer. If the voltage level of the voltage data VD is lower, the time length of the emission period EP is shorter. The time length of the emission period EP of the driving current DI is determined by the voltage data VD and the ramp signal SS. In other word, the pixel unit may be dimming by the voltage data VD to determine the time length of the turn light period of the pixel unit. In addition, in the embodiment of the disclosure, the ramp signal SS is a ramp-up signal, but the disclosure is not limited thereto. In one embodiment of the disclosure, the ramp signal SS may be a ramp-down signal.

Figure 3:
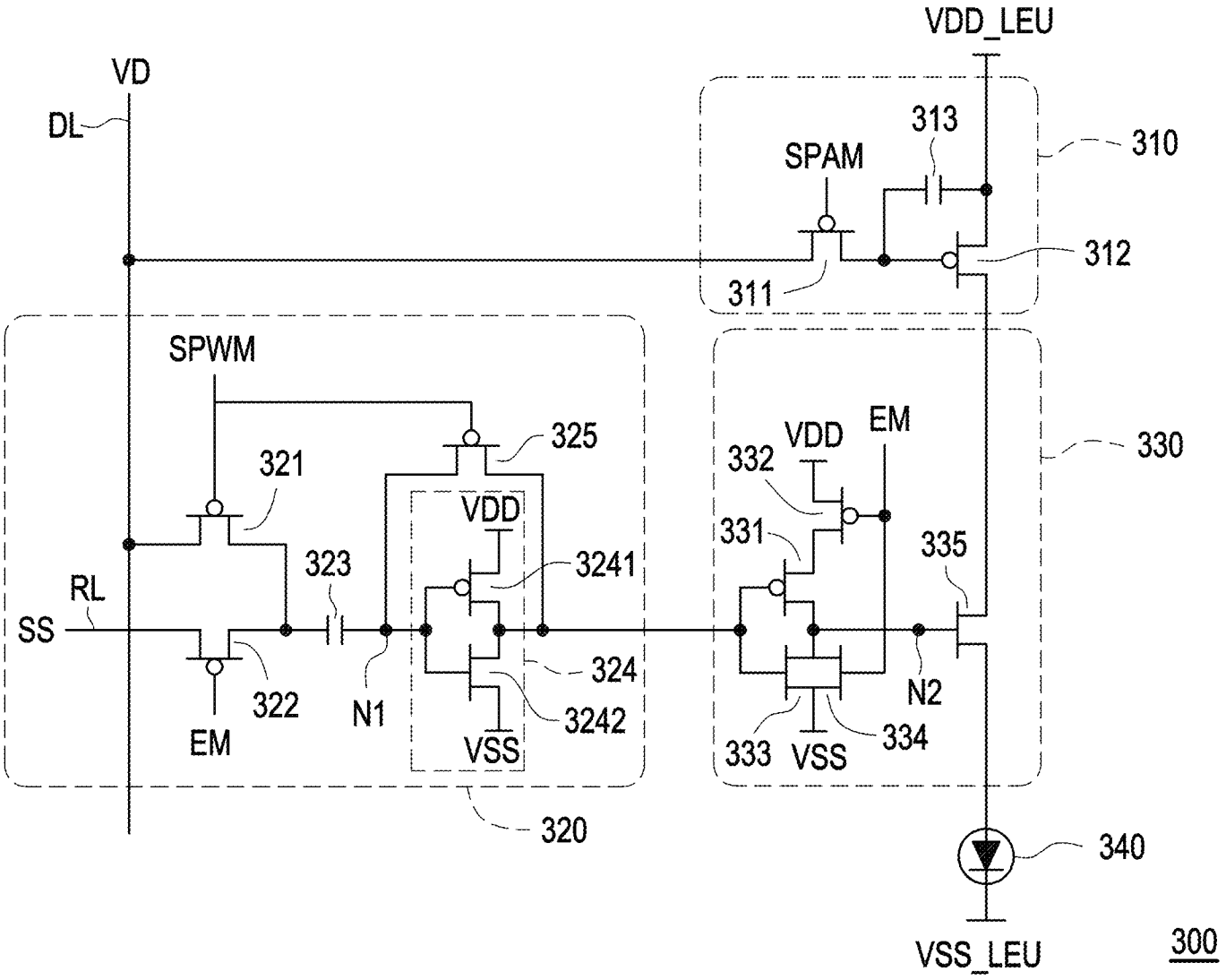
FIG. 3 is a schematic diagram of a display device according to another embodiment of the disclosure.

FIG. 3 is a schematic diagram of a display device according to another embodiment of the disclosure. Referring to FIG. 3, the display device 300 includes a pixel array, and the pixel array includes a plurality of pixel units, wherein each of the plurality of pixel units may include the circuit architecture as shown in FIG. 3. In the embodiment of the disclosure, the display device 300 includes a current source 310, a voltage comparator 320, an emission control unit 330 and a light emitting unit 340. The current source 310 is coupled between an operation voltage VDD_LEU and the emission control unit 330. The emission control unit 330 is further coupled to the voltage comparator 320 and the light emitting unit 340, and receives the emission enable signal EM. The light emitting unit 340 is coupled between the emission control unit 330 and a voltage VSS_LEU. The voltage VSS_LEU is lower than the operation voltage VDD_LEU. In the embodiment of the disclosure, the current source 330 is configured to output a supply current to the emission control unit 330. The voltage comparator 320 is configured to receive a voltage data VD through a data line DL, and receive a ramp signal SS through a signal line RL. The voltage comparator 320 outputs a comparison signal to the emission control unit 330 according to the voltage data VD and the ramp signal SS, and the emission control unit 330 outputs a driving current to the light emitting unit 340 according to the supply current, the emission enable signal EM, and the comparison signal CS. In the embodiment of the disclosure, the emission enable signal EM, the voltage data VD, and the ramp signal SS may be provided from multiple driving circuits respectively arranged out of a plane of the display device 300 or arranged inside the plane of the display device 300.

In the embodiment of the disclosure, the current source 310 includes a transistor 311, a transistor 312, and a capacitor 313. A first terminal of the transistor 311 is coupled to the data line DL and receives the voltage data VD, and a control terminal of the transistor 311 receives a pulse-amplitude modulation scan signal SPAM. A first terminal of the transistor 312 receives the operation voltage VDD_LEU, a control terminal of the transistor 312 is coupled to a second terminal of the transistor 311, and a second terminal of the transistor 312 is coupled to the emission control unit 330. A first terminal of the capacitor 313 is coupled to the second terminal of the transistor 311, and a second terminal of the capacitor 313 is coupled to the first terminal of the transistor 312. In the embodiment of the disclosure, the transistors 311 and 312 are P-type transistors. In the embodiment of the disclosure, the current source 310 receives the pulse-amplitude modulation scan signal SPAM for voltage programming on the voltage of the control terminal of the transistor 312, so as to modulate the current of the supply current outputted through the second terminal of the transistor 312.

In the embodiment of the disclosure, the voltage comparator 320 includes a plurality of transistors 321, 322, and 325, a capacitor 323, and an inverter circuit 324. A first terminal of the transistor 321 is coupled to the data line DL and receives the voltage data VD, and a control terminal of the transistor 321 receives a pulse-width modulation scan signal SPWM. A first terminal of the transistor 322 receives the ramp signal SS, a control terminal of the transistor 322 receives the emission enable signal EM, and a second terminal of the transistor 322 is coupled to a second terminal of the transistor 321. A first terminal of the capacitor 323 is coupled to the second terminal of the transistor 322 and the second terminal of the transistor 321. An input terminal of the inverter circuit 324 is coupled to a second terminal of the capacitor 323, and an output terminal of the inverter circuit 324 is coupled to the emission control unit 330. A first terminal of the transistor 325 is coupled to the input terminal of the inverter circuit 324, a control terminal of the transistor 325 receives the pulse-width modulation scan signal SPWM, and a second terminal of the transistor 325 is coupled to the output terminal of the inverter circuit 324. In the embodiment of the disclosure, the transistors 321, 322 and 325 are P-type transistors. The voltage comparator 320 performs voltage programming on the voltage data VD according to the pulse-width modulation scan signal SPWM, so that the second terminal of the transistor 321 may outputs a pulse-width modulation voltage.

In the embodiment of the disclosure, the inverter circuit 324 includes a transistor 3241 and a transistor 3242. A first terminal of the transistor 3241 receives an operation voltage VDD, a control terminal of the transistor 3241 is coupled to the input terminal of the inverter circuit 324, and a second terminal of the transistor 3241 is coupled to the output terminal of the inverter circuit 324. A first terminal of the transistor 3242 receives a voltage VSS, a control terminal of the transistor 3242 is coupled to the input terminal of the inverter circuit 324, and a second terminal of the transistor 3242 is coupled to the output terminal of the inverter circuit 324. The voltage VSS is lower than the operation voltage VDD. In the embodiment of the disclosure, the transistor 3241 is P-type transistor, and the transistor 3242 is N-type transistor.

In the embodiment of the disclosure, the emission control unit 330 includes a plurality of transistors 331 to 335. A control terminal of the transistor 331 is coupled to the voltage comparator 320. A first terminal of the transistor 332 is coupled to the operation voltage VDD, a control terminal of the transistor 332 receives the emission enable signal EM, and a second terminal of the transistor 332 is coupled to a first terminal of the transistor 331. A first terminal of the transistor 333 is couple to a second terminal of the transistor 331, a control terminal of the transistor 333 is coupled to the voltage comparator 320, and a second terminal of the transistor 333 is coupled to the voltage VSS. The voltage VSS is lower than the operation voltage VDD. A first terminal of the transistor 334 is coupled to the second terminal of the transistor 331, a control terminal of the transistor 334 receives the emission enable signal EM, and a second terminal of the transistor 334 is coupled to the voltage VSS. A first terminal of the transistor 335 is coupled to the current source 310, a control terminal of the transistor 335 is coupled to the second terminal of the transistor 331, and a second terminal of the transistor 335 is coupled to the light emitting unit 340. In the embodiment of the disclosure, the transistors 321 and 322 are P-type transistors, and the transistors 323 and 324 are N-type transistors.

Figure 4:
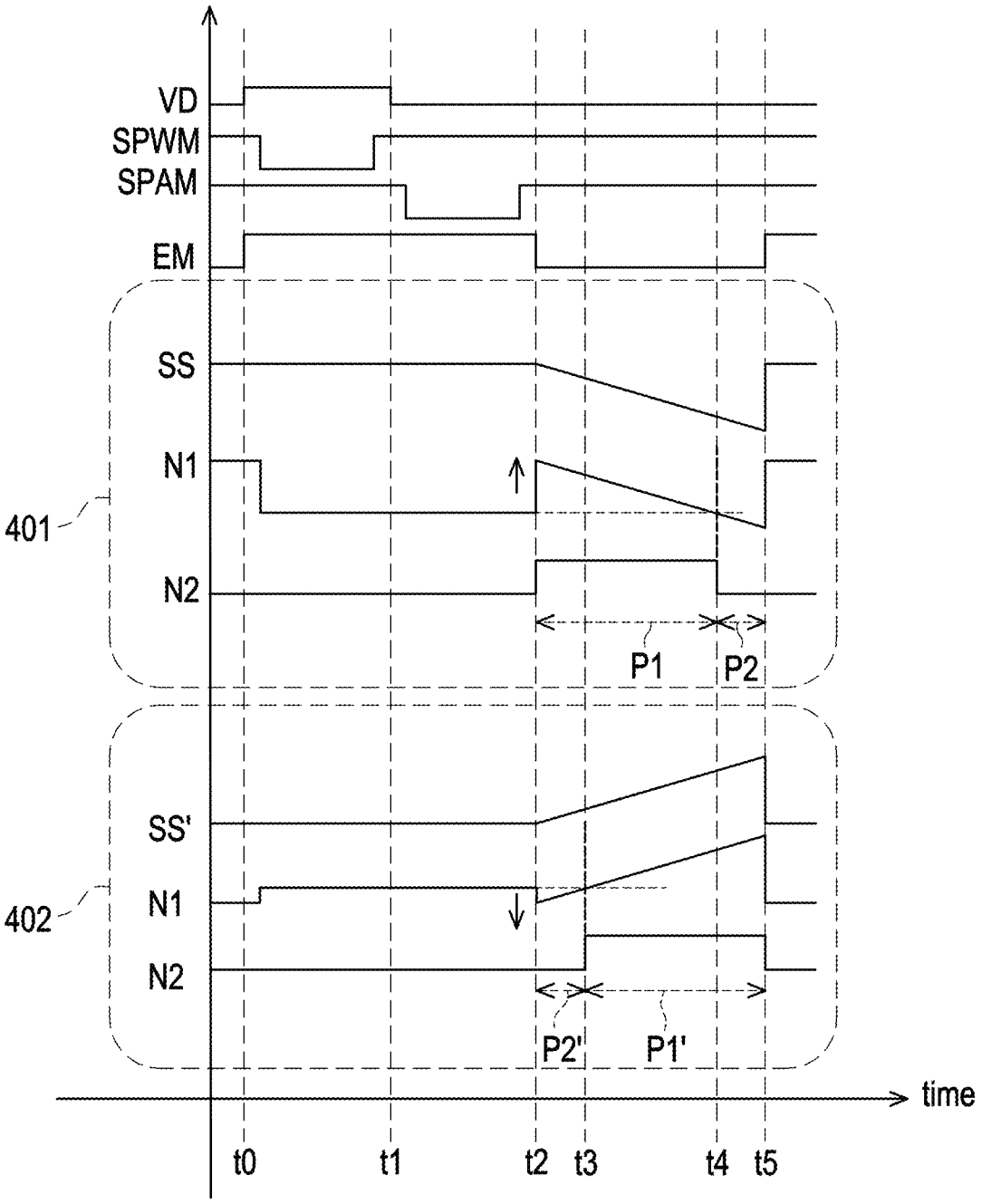
FIG. 4 is a schematic diagram of signals according to the embodiment of FIG. 3 of the disclosure.

FIG. 4 is a schematic diagram of signals according to the embodiment of FIG. 3 of the disclosure. Referring to FIG. 3 and FIG. 4, during the period from time t0 to time t1, the voltage of the pulse-width modulation scan signal SPWM changes from the high voltage level to the low voltage level, so as to turn-on the transistors 321 and 325. The data line DL transmits the voltage data VD having pulse-width modulation data. During the period from time t1 to time t2, the voltage of the pulse-amplitude modulation scan signal SPAM changes from the high voltage level to the low voltage level, so as to turn-on the transistor 311. The data line DL transmits the voltage data VD having pulse-amplitude modulation data. During the data setup period from time t0 to time t2, the voltage of the emission enable signal EM changes from the low voltage level to the high voltage level, so as to turn-off the transistors 322 and 332, and turn-on the transistor 334. During the emission period from time t2 to time t5, the voltage of the emission enable signal EM changes from the high voltage level to the low voltage level, so as to turn-on the transistors 322 and 332, and turn-off the transistor 334.

In first ramp signal type 401, the voltage comparator 320 may receive the ramp signal SS. During the data setup period from time t0 to time t2, the ramp signal SS has the high voltage level, the node voltage N1 changes from the relatively high voltage level to a threshold voltage (Vth). During the data setup period from time t0 to time t2, due to the transistor 334 is turned-on, the node voltage N2 is maintained at the low voltage level. At time t2, the ramp signal SS (ramp-down signal) starts to drop down, and the node voltages N1 and N2 change from the threshold voltage (Vth) to the relatively high voltage level, so that the transistor 335 is turned-on to provide the driving current to the light emitting unit 340. At time t2, the light emitting unit 340 is lighted up. During the emission period from time t2 to time t5, the voltage of the ramp signal SS drops down, and the node voltage N1 synchronously drops down. After time t4, due to the node voltage N1 is lower than the threshold voltage, after voltage inverting, the transistor 331 is turned-off and the transistor 333 is turned-on. Thus, the node voltage N2 changes from the high voltage level to the low voltage level, so that the transistor 335 is turned-off and the light emitting unit 340 is also turned-off. Thereof, the display device 300 can perform the effective dimming function on the light emitting unit 340. It should be noted that, the light emitting unit 340 is lighted up first during the turn-on period (lighting period) P1 (all light emitting units are lighted up), and then the light emitting unit 340 is turned off during the turn-off period (dimming period) P2 to perform the data setup (All light-emitting units are turned-off sequentially or at the same time).

In second ramp signal type 402, the voltage comparator 320 may receive the ramp signal SS'. During the data setup period from time t0 to time t2, the ramp signal SS' has the low voltage level, and the node voltage N1 changes from the relatively low voltage level to the threshold voltage (Vth). During the data setup period from time t0 to time t2, due to the transistor 334 is turned-on, the node voltage N2 is maintained at the low voltage level. At time t2, the ramp signal SS' (ramp-up signal) starts to rise, and the node voltage N1 changes from the threshold voltage (Vth) to the relatively low voltage level, so that the transistor 335 is turned-off and the light emitting unit 340 is also turned-off. During the period from time t2 to time t3, the voltage of the ramp signal SS' is rising, and the node voltage N1 is synchronously rising. After time t3, due to the node voltage N1 is higher than the threshold voltage, after voltage inverting, the node voltage N2 changes from the low voltage level to the high voltage level, so that the transistor 331 is turned-on and the transistor 333 is turned-off. Thus, the transistor 335 is turned-on and the light emitting unit 340 is lighted up. Thereof, the display device 300 can perform the effective dimming function on the light emitting unit 340. It should be noted that the light emitting unit 340 is turned off first during the turn-off period (dimming period) P2' to perform the data setup (all light emitting units are turned-off), and then the light emitting unit 340 is lighted up first during the turn-on period (lighting period) P1' (All light-emitting units are lighted up sequentially or at the same time).

Figure 5:
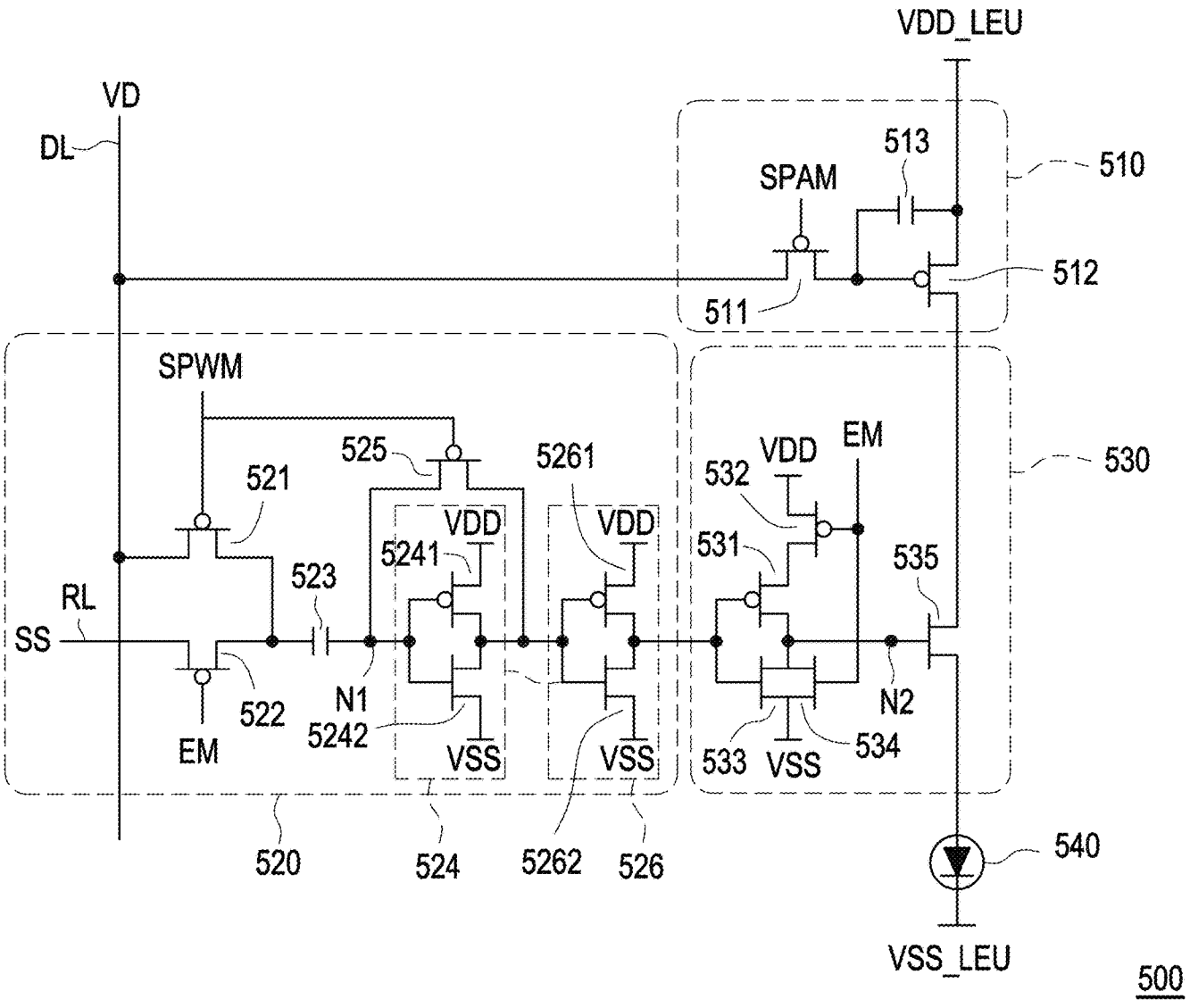
FIG. 5 is a schematic diagram of a display device according to yet another embodiment of the disclosure.

FIG. 5 is a schematic diagram of a display device according to yet another embodiment of the disclosure. Referring to FIG. 5, the display device 500 includes a pixel array, and the pixel array includes a plurality of pixel units, wherein each of the plurality of pixel units may include the circuit architecture as shown in FIG. 5. In the embodiment of the disclosure, the display device 500 includes a current source 510, a voltage comparator 520, an emission control unit 530 and a light emitting unit 540. The current source 510 is coupled between an operation voltage VDD_LEU and the emission control unit 530. The emission control unit 530 is further coupled to the voltage comparator 520 and the light emitting unit 540, and receives the emission enable signal EM. The light emitting unit 540 is coupled between the emission control unit 530 and a voltage VSS_LEU. The voltage VSS_LEU is lower than the operation voltage VDD_LEU. In the embodiment of the disclosure, the current source 530 is configured to output a supply current to the emission control unit 530. The voltage comparator 520 is configured to receive a voltage data VD through a data line DL, and receive a ramp signal SS through a signal line RL. The voltage comparator 520 outputs a comparison signal CS to the emission control unit 530 according to the voltage data VD and the ramp signal SS, and the emission control unit 530 outputs a driving current to the light emitting unit 540 according to the supply current, the emission enable signal EM, and the comparison signal CS. In the embodiment of the disclosure, the emission enable signal EM, the voltage data VD, and the ramp signal SS may be provided from multiple driving circuits respectively arranged out of a plane of the display device 500 or arranged inside the plane of the display device 500.

In the embodiment of the disclosure, the current source 510 includes a transistor 511, a transistor 512, and a capacitor 513. A first terminal of the transistor 511 is coupled to the data line DL and receives the voltage data VD, and a control terminal of the transistor 511 receives a pulse-amplitude modulation scan signal SPAM. A first terminal of the transistor 512 receives the operation voltage VDD_LEU, a control terminal of the transistor 512 is coupled to a second terminal of the transistor 511, and a second terminal of the transistor 512 is coupled to the emission control unit 530. A first terminal of the capacitor 513 is coupled to the first terminal of the transistor 511, and a second terminal of the capacitor 513 is coupled to the second terminal of the transistor 512. In the embodiment of the disclosure, the transistors 511 and 512 are P-type transistors. In the embodiment of the disclosure, the current source 510 receives the pulse-amplitude modulation scan signal SPAM for voltage programming on the voltage of the control terminal of the transistor 512, so as to modulate the current of the supply current outputted through the second terminal of the transistor 512.

In the embodiment of the disclosure, the voltage comparator 520 includes a plurality of transistors 521, 522, and 525, a capacitor 523, an inverter circuit 524, and a transistor 525. A first terminal of the transistor 521 is coupled to the data line DL and receives the voltage data VD, and a control terminal of the transistor 521 receives a pulse-width modulation scan signal SPWM. A first terminal of the transistor 522 receives the ramp signal SS, a control terminal of the transistor 522 receives the emission enable signal EM, and a second terminal of the transistor 522 is coupled to a second terminal of the transistor 521. A first terminal of the capacitor 523 is coupled to the second terminal of the transistor 522 and the second terminal of the transistor 521. An input terminal of the inverter circuit 524 is coupled to a second terminal of the capacitor 523, and an output terminal of the inverter circuit 524 is coupled to the inverter circuit 526. A first terminal of the transistor 525 is coupled to the input terminal of the inverter circuit 524, a control terminal of the transistor 525 receives the pulse-width modulation scan signal SPWM, and a second terminal of the transistor 525 is coupled to the output terminal of the inverter circuit 524. An input terminal of the inverter circuit 526 is coupled to the output terminal of the inverter circuit 524, and an output terminal of the inverter circuit 526 is coupled to the emission control unit 530. In the embodiment of the disclosure, the transistors 521, 522 and 525 are P-type transistors. The voltage comparator 520 performs voltage programming on the voltage data VD according to the pulse-width modulation scan signal SPWM, so that the second terminal of the transistor 521 may outputs a pulse-width modulation voltage.

In the embodiment of the disclosure, the inverter circuit 524 includes a transistor 5241 and a transistor 5242. A first terminal of the transistor 5241 receives an operation voltage VDD, a control terminal of the transistor 5241 is coupled to the input terminal of the inverter circuit 524, and a second terminal of the transistor 5241 is coupled to the output terminal of the inverter circuit 524. A first terminal of the transistor 5242 receives a voltage VSS, a control terminal of the transistor 5242 is coupled to the input terminal of the inverter circuit 524, and a second terminal of the transistor 5242 is coupled to the output terminal of the inverter circuit 524. The voltage VSS is lower than the operation voltage VDD. In the embodiment of the disclosure, the transistor 5241 is P-type transistor, and the transistor 5242 is N-type transistor.

In the embodiment of the disclosure, the inverter circuit 526 includes a transistor 5261 and a transistor 5262. A first terminal of the transistor 5261 receives an operation voltage VDD, a control terminal of the transistor 5261 is coupled to the input terminal of the inverter circuit 526, and a second terminal of the transistor 5261 is coupled to the output terminal of the inverter circuit 526. A first terminal of the transistor 5262 receives a voltage VSS, a control terminal of the transistor 5262 is coupled to the input terminal of the inverter circuit 526, and a second terminal of the transistor 5262 is coupled to the output terminal of the inverter circuit 526. In the embodiment of the disclosure, the transistor 5261 is P-type transistor, and the transistor 5262 is N-type transistor.

In the embodiment of the disclosure, the emission control unit 530 includes a plurality of transistors 531 to 535. A control terminal of the transistor 531 is coupled to the voltage comparator 520. A first terminal of the transistor 532 is coupled to the operation voltage VDD, a control terminal of the transistor 532 receives the emission enable signal EM, and a second terminal of the transistor 532 is coupled to a first terminal of the transistor 531. A first terminal of the transistor 533 is couple to a second terminal of the transistor 531, a control terminal of the transistor 533 is coupled to the voltage comparator 520, and a second terminal of the transistor 533 is coupled to the voltage VSS. A first terminal of the transistor 534 is coupled to the second terminal of the transistor 531, a control terminal of the transistor 534 receives the emission enable signal EM, and a second terminal of the transistor 534 is coupled to the voltage VSS. A first terminal of the transistor 535 is coupled to the current source 510, a control terminal of the transistor 535 is coupled to the second terminal of the transistor 531, and a second terminal of the transistor 535 is coupled to the light emitting unit 540. In the embodiment of the disclosure, the transistors 521 and 522 are P-type transistors, and the transistors 523 and 524 are N-type transistors.

Figure 6:
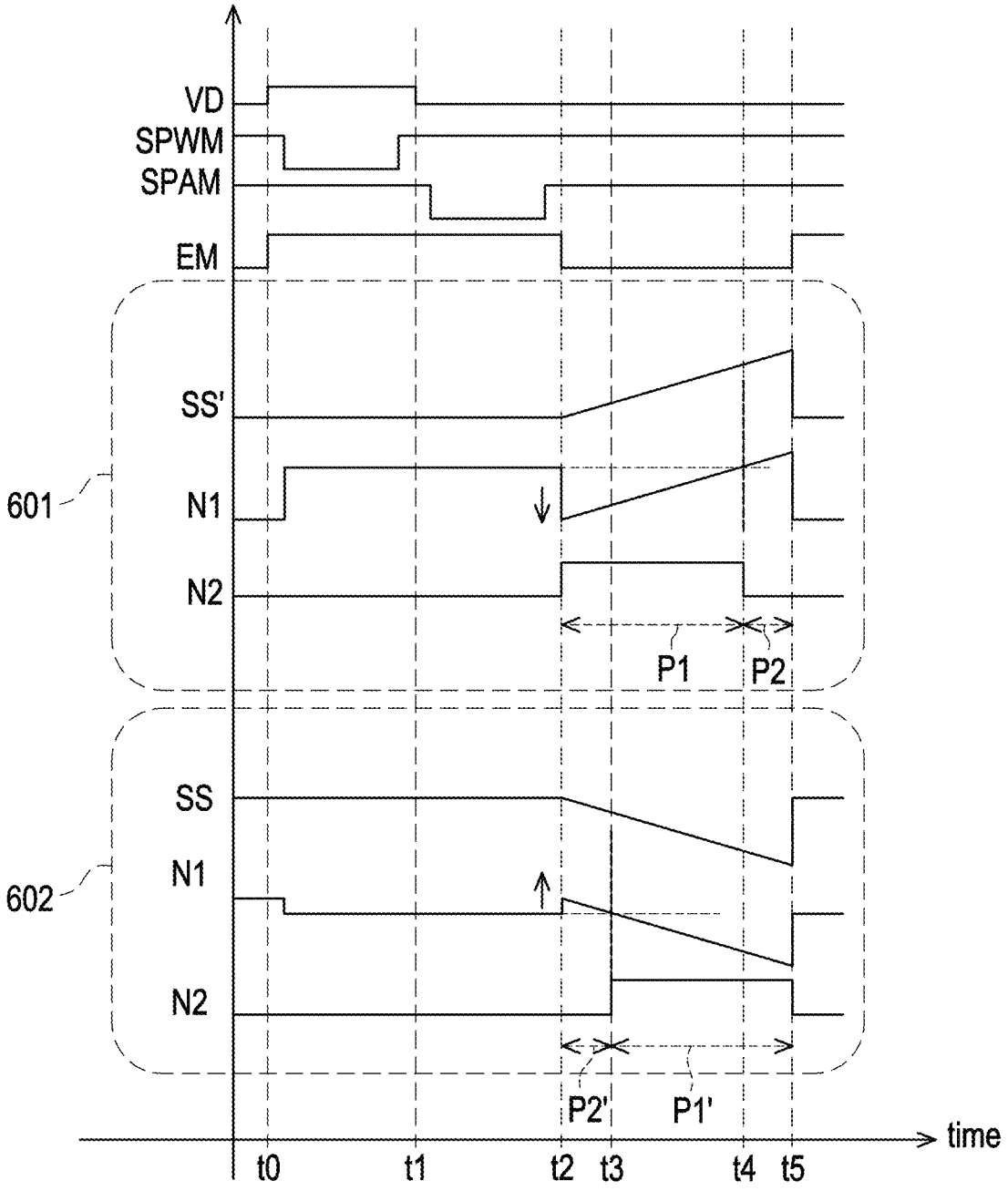
FIG. 6 is a schematic diagram of signals according to the embodiment of FIG. 5 of the disclosure.

FIG. 6 is a schematic diagram of signals according to the embodiment of FIG. 5 of the disclosure. Referring to FIG. 5 and FIG. 6, during the period from time t0 to time t1, the voltage of the pulse-width modulation scan signal SPWM changes from the high voltage level to the low voltage level, so as to turn-on the transistors 521 and 525. The data line DL transmits the voltage data VD having pulse-width modulation data. During the period from time t1 to time t2, the voltage of the pulse-amplitude modulation scan signal SPAM changes from the high voltage level to the low voltage level, so as to turn-on the transistor 511. The data line DL transmits the voltage data VD having pulse-amplitude modulation data. During the data setup period from time t0 to time t2, the voltage of the emission enable signal EM changes from the low voltage level to the high voltage level, so as to turn-off the transistors 522 and 532, and turn-on the transistor 534. During the emission period from time t2 to time t5, the voltage of the emission enable signal EM changes from the high voltage level to the low voltage level, so as to turn-on the transistors 522 and 532, and turn-off the transistor 534.

In first signal type 601, the voltage comparator 520 may receive the ramp signal SS'. During the data setup period from time t0 to time t2, the ramp signal SS' has the high voltage level, the node voltage N1 changes from the relatively low voltage level to the threshold voltage (Vth). During the data setup period from time t0 to time t2, due to the transistor 534 is turned-on, the node voltage N2 is maintained at the low voltage level. At time t2, the ramp signal SS' (ramp-up signal) starts to rise, the node voltages N1 changes from the threshold voltage (Vth) to the relatively low voltage level, and the node voltage N2 changes from the low voltage level to the high voltage level, so that the transistor 535 is turned-on to provide the driving current to the light emitting unit 540. At time t2, the light emitting unit 540 is lighted up. During the emission period from time t2 to time t5, the voltage of the ramp signal SS' is rising, and the node voltage N1 is synchronously rising. After time t4, due to the node voltage N1 is higher than the threshold voltage, the transistor 531 is turned-off and the transistor 533 is turned-on. Thus, the node voltage N2 changes from the high voltage level to the low voltage level, so that the transistor 535 is turned-off and the light emitting unit 540 is also turned-off. Thereof, the display device 500 can perform the effective dimming function on the light emitting unit 540. It should be noted that the light emitting unit 540 is lighted up first during the turn-on period (lighting period) P1 from time t2 to time t4 (all light emitting units are lighted up), and then the light emitting unit 540 is turned off during the turn-off period (dimming period) P2 from time t4 to time t5 to perform the data setup (All light-emitting units are turned-off sequentially or at the same time). The total time length of the sum of the time lengths of the turn-on period P1 and the turn-off period P2 is equal to the emission period (time t2 to time t5).

In first signal type 602, the voltage comparator 520 may receive the ramp signal SS. During the data setup period from time t0 to time t2, the ramp signal SS has the high voltage level, the node voltage N1 changes from the relatively high voltage level to the threshold voltage (Vth). During the data setup period from time t0 to time t2, due to the transistor 534 is turned-on, the node voltage N2 is maintained at the low voltage level. At time t2, the ramp signal SS (ramp-down signal) starts to drop down, and the node voltage N1 changes from the threshold voltage (Vth) to the relatively high voltage level. The node voltage N2 is maintained at the low voltage level, so that the transistor 535 is turned-off and the light emitting unit 540 is also turned-off. During the turn-off period (dimming period) period P2' from time t2 to time t3, the voltage of the ramp signal SS is dropping down, and the node voltage N1 is synchronously dropping down. After time t3, due to the node voltage N1 is lower than the threshold voltage, the node voltage N2 changes from the low voltage level to the high voltage level, after voltage inverting, the transistor 531 is turned-on and the transistor 533 is turned-off. Thus, the transistor 535 is turned-on and the light emitting unit 540 is lighted up. Thereof, the display device 500 can perform the effective dimming function on the light emitting unit 540. It should be noted that the light emitting unit 540 is turned off first during the turn-off period (dimming period) P2' to perform the data setup (all light emitting units are turned-off), and then the light emitting unit 350 is lighted up first during the turn-on period (lighting period) P1' from time t3 to time t5 (All light-emitting units are lighted up sequentially or at the same time). The total time length of the sum of the time lengths of the turn-on period P1' and the turn-off period P2' is equal to the emission period (time t2 to time t5).

Figure 7:
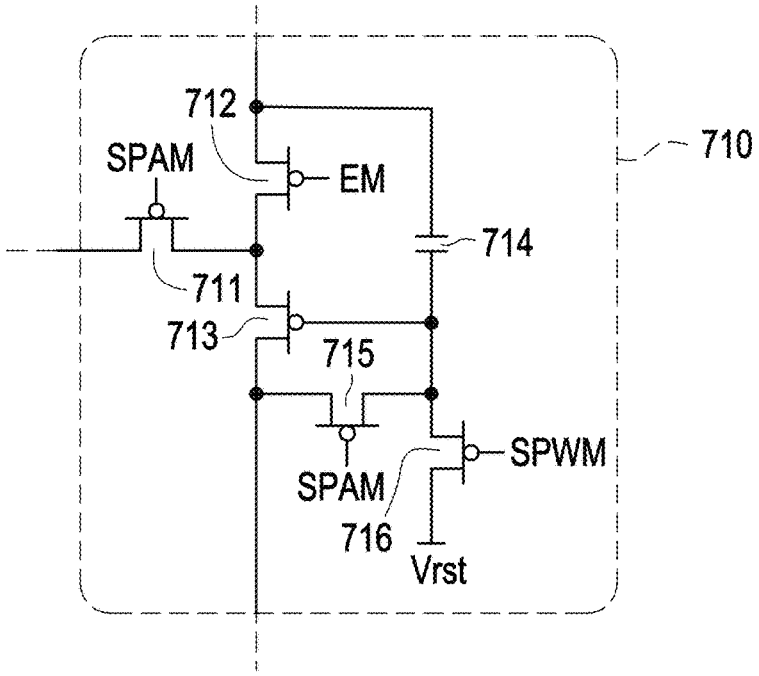
FIG. 7 is a schematic diagram of a current source according to another embodiment of the disclosure.

FIG. 7 is a schematic diagram of a current source according to another embodiment of the disclosure. Referring to FIG. 7, the current source 310 and the current source 510 of the above embodiments of FIG. 3 and FIG. 5 may be replaced by the current source 710 having a threshold voltage compensation function. In the embodiment of the disclosure, the current source 710 includes a plurality of transistors 711 to 713, 715, and 716, and a capacitor 714. A first terminal of the transistor 711 is coupled to a data line and receives the voltage data, and a control terminal of the transistor 711 receives the pulse-amplitude modulation scan signal SPAM. A first terminal of the transistor 712 receives the operation voltage, a control terminal of the transistor 712 receives the emission enable signal EM, and a second terminal of the transistor 712 is couple to a second terminal of the transistor 711. A first terminal of the transistor 713 is couple to the second terminal of the transistor 712, and a second terminal of the transistor 713 is coupled to the emission control unit. A first terminal of the capacitor 714 is coupled to the first terminal of the transistor 712, and a second terminal of the capacitor 714 is coupled to a control terminal of the transistor 713. A first terminal of the transistor 715 is coupled to the second terminal of the transistor 713, a control terminal of the transistor 715 receives the pulse-amplitude modulation scan signal, and a second terminal of the transistor 715 is coupled to the control terminal of the transistor 713. A first terminal of the transistor 716 is coupled to the second terminal of the transistor 715, a control terminal of the transistor 716 receives the pulse-width modulation scan signal SPWM, and a second terminal of the transistor 716 is coupled to a reset voltage Vrst.

Figure 8:
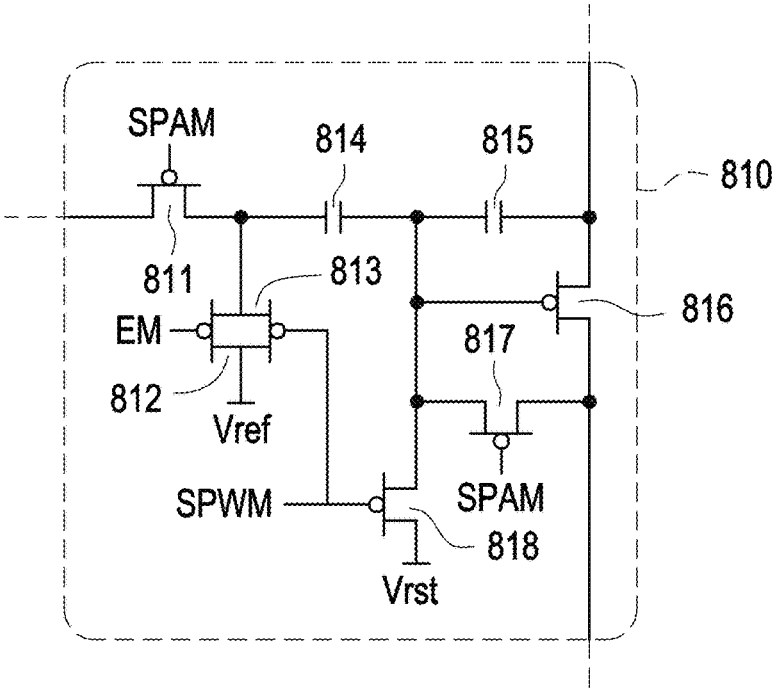
FIG. 8 is a schematic diagram of a current source according to yet another embodiment of the disclosure.

FIG. 8 is a schematic diagram of a current source according to yet another embodiment of the disclosure. Referring to FIG. 8, the current source 310 and the current source 510 of the above embodiments of FIG. 3 and FIG. 5 may be replaced by the current source 810 having a threshold voltage compensation function. In the embodiment of the disclosure, the current source 810 includes a plurality of transistors 811 to 813, and 816 to 818, a capacitor 814 and a capacitor 815. A first terminal of the transistor 811 is coupled to a data line and receives the voltage data, and a control terminal of the transistor 811 receives the pulse-amplitude modulation scan signal SPAM. A first terminal of the transistor 812 is coupled to a second terminal of the transistor 811, a control terminal of the transistor 812 receives the emission enable signal EM, and a second terminal of the transistor 812 is coupled to a reference voltage Vref. A first terminal of the transistor 813 is coupled to the second terminal of the transistor 811, a control terminal of the transistor 813 receives a pulse-width modulation scan signal SPWM, and a second terminal of the transistor 813 is coupled to the reference voltage Vref. A first terminal of the capacitor 814 is coupled to the second terminal of the transistor 811. A first terminal of the capacitor 815 is coupled to the second terminal of the capacitor 814, and a second terminal of the capacitor 815 receives the operation voltage. A first terminal of the transistor 816 is coupled to the second terminal of the capacitor 815 and the operation voltage, a control terminal of the transistor 816 is coupled to the first terminal of the capacitor 815. A first terminal of the transistor 817 is coupled to the first terminal of the capacitor 815, a control terminal of the transistor 817 receives the pulse-amplitude modulation scan signal SPAM, and a second terminal of the transistor 817 is coupled to a second terminal of the transistor 816. A first terminal of the transistor 818 is coupled to the first terminal of the capacitor 815, a control terminal of the transistor 818 receives the pulse-width modulation scan signal SPWM, and a second terminal of the transistor 818 is coupled to the reset voltage Vrst.

Figure 9B:
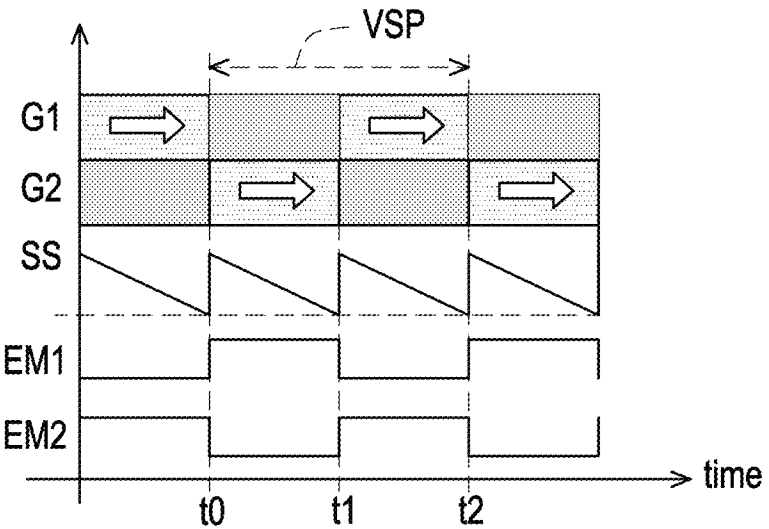
FIG. 9B is a schematic diagram of signals and dimming operations according to a second embodiment of the disclosure.
Figure 9A:
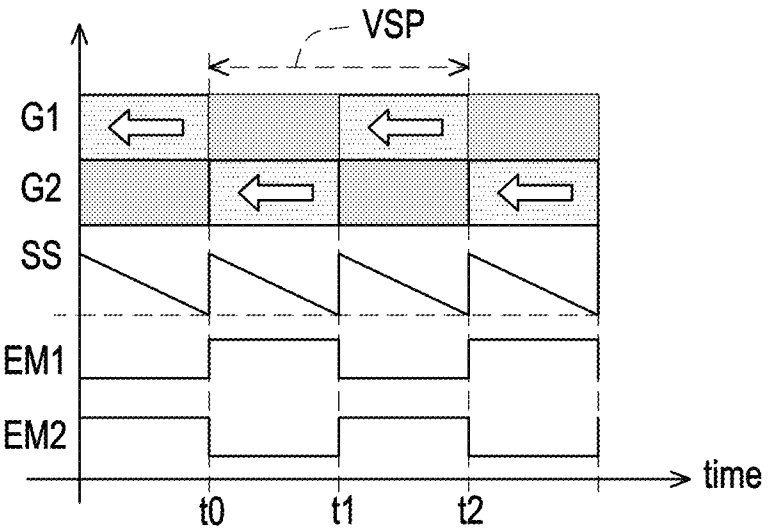
FIG. 9A is a schematic diagram of signals and dimming operations according to a first embodiment of the disclosure.

FIG. 9A is a schematic diagram of signals and dimming operations according to a first embodiment of the disclosure. Referring to FIG. 9A, the display device of the embodiment includes a pixel array. The pixel array includes a plurality of pixel units, and the plurality of pixel units are respectively operated as the first ramp signal type 401 of the above embodiment of FIG. 4. The plurality of pixel units of the display device of the embodiment can be realized by referring the pixel circuit of the embodiment of FIG. 3. The plurality of pixel units are divided into a plurality of pixel groups for receiving different emission enable signals, and the plurality of pixel groups receive the common ramp signal SS. In the embodiment of the disclosure, the plurality of pixel units are divided into two pixel groups G1 and G2. The pixel groups G1 and G2 may respectively receive the emission enable signals EM1 and EM2, and receive a common ramp signal SS. The common ramp signal SS includes a plurality of sub ramp-down signals. During a period from time t0 to time t1, corresponding to the emission enable signal EM1 having the high voltage level (corresponding to the data setup period described in the above embodiment) and the emission enable signal EM2 having the low voltage level (corresponding to the enable period described in the above embodiment), the pixel group G1 may be operated in the data setup mode (light emitting units are turned-off), and the pixel group G2 may be operated in the dimming mode (light-emitting units are lighted up sequentially or at the same time). The all of light emitting units of the pixel group G2 are lighted up at the same time, and then all light-emitting units of the pixel group G2 are turned-off sequentially or at the same time after different or same emission periods. During a period from time t1 to time t2, corresponding to the emission enable signal EM1 having the low voltage level (corresponding to the enable period described in the above embodiment) and the emission enable signal EM2 having the high voltage level (corresponding to the data setup period described in the above embodiment), the pixel group G1 may be operated in the dimming mode (light-emitting units are lighted up sequentially or at the same time), and the pixel group G2 may be operated in the data setup mode (light emitting units are turned-off). The all of light emitting units of the pixel group G1 are lighted up at the same time, and then all light-emitting units of the pixel group G1 are turned-off sequentially or at the same time after different or same emission periods.

It should be noted that, the plurality of ramp periods respectively corresponding to the sub ramp-down signals of the common ramp signal SS are respectively overlap with the data setup period and emission period of emission enable signals EM1 and EM2. One vertical scan period VSP of display device of the embodiment includes one data setup period and one emission period. The pixel groups G1 and G2 are lighted up during the different emission periods, and setup during different data setup periods according to the emission enable signals EM1 and EM2 respectively. The different data setup periods respectively corresponding to the pixel groups G1 and G2 are non-overlapping with each other in time. Moreover, the data setup period corresponding to one of the emission enable signals EM1 and EM2 overlaps with the emission period corresponding to another one of the emission enable signals EM1 and EM2. Therefore, the display device of the embodiment can effective reduce the on-peak power consumption, in particular, can avoid the occurrence of IR-drop and no light if all pixel units are operated in the data setup mode (light emitting units are turned-off).

FIG. 9B is a schematic diagram of signals and dimming operations according to a second embodiment of the disclosure. Referring to FIG. 9B, the display device of the embodiment includes a pixel array. The pixel array includes a plurality of pixel units, and the plurality of pixel units are respectively operated as the second ramp signal type 602 of the above embodiment of FIG. 6. The plurality of pixel units of the display device of the embodiment can be realized by referring the pixel circuit of the embodiment of FIG. 5. The plurality of pixel units are divided into a plurality of pixel groups for receiving different emission enable signals, and the plurality of pixel groups receive the common ramp signal SS. In the embodiment of the disclosure, similar to above embodiment of FIG. 9A, the plurality of pixel units are divided into two pixel groups G1 and G2. The pixel groups G1 and G2 may respectively receive the emission enable signals EM1 and EM2, and receive a common ramp signal SS. The common ramp signal SS includes a plurality of sub ramp-down signals.

Different from the above embodiment of FIG. 9A, during a period from time t0 to time t1, the all of light emitting units of the pixel group G2 are turned-off first, and then the all of light-emitting units of the pixel group G2 are lighted up sequentially or at the same time after different or same data setup periods. During a period from time t1 to time t2, the all light emitting units of the pixel group G1 are turned-off first, and then the all of light-emitting units of the pixel group G1 are lighted up sequentially or at the same time after different or same data setup periods. Therefore, the display device of the embodiment can effective reduce the on-peak power consumption, in particular, can avoid the occurrence of IR-drop and no light if all pixel units are operated in the data setup mode (light emitting units are turned-off).

Figure 9D:
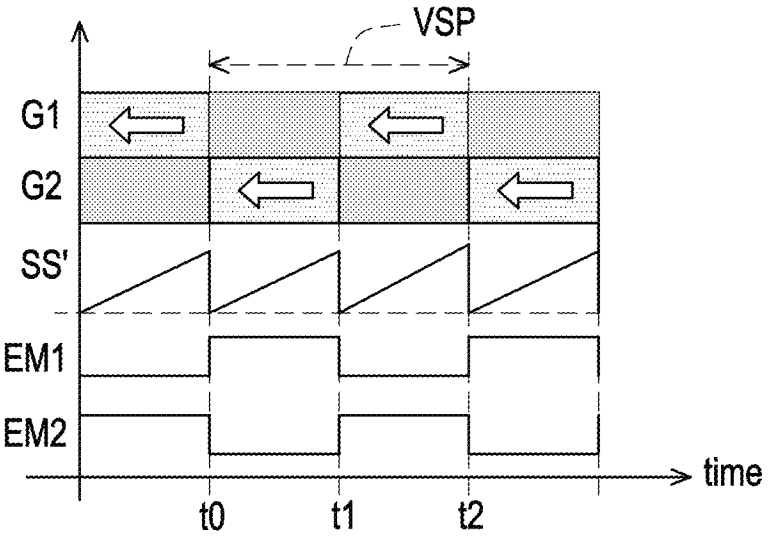
FIG. 9D is a schematic diagram of signals and dimming operations according to a forth embodiment of the disclosure.
Figure 9C:
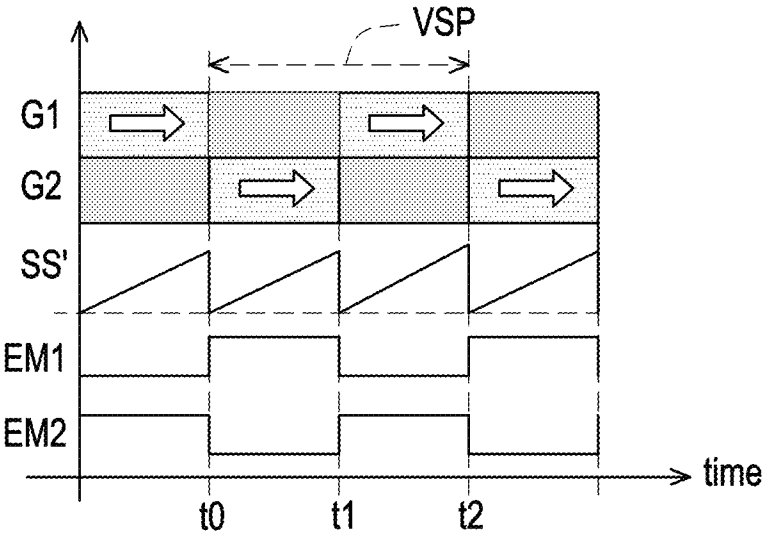
FIG. 9C is a schematic diagram of signals and dimming operations according to a third embodiment of the disclosure.

FIG. 9C is a schematic diagram of signals and dimming operations according to a third embodiment of the disclosure. Referring to FIG. 9C, the display device of the embodiment includes a pixel array. The pixel array includes a plurality of pixel units, and the plurality of pixel units are respectively operated as the second ramp signal type 402 of the above embodiment of FIG. 4. The plurality of pixel units of the display device of the embodiment can be realized by referring the pixel circuit of the embodiment of FIG. 3. The plurality of pixel units are divided into a plurality of pixel groups for receiving different emission enable signals, and the plurality of pixel groups receive the common ramp signal SS'. In the embodiment of the disclosure, similar to above embodiment of FIG. 9B, the plurality of pixel units are divided into two pixel groups G1 and G2. The pixel groups G1 and G2 may respectively receive the emission enable signals EM1 and EM2. Different from the above embodiment of FIG. 9B, the pixel groups G1 and G2 may respectively receive a common ramp signal SS'. The common ramp signal SS' includes a plurality of sub ramp-up signals.

During a period from time t0 to time t1, the all of light emitting units of the pixel group G2 are turned-off first, and then the all of light-emitting units of the pixel group G2 are lighted up sequentially or at the same time after different or same data setup periods. During a period from time t1 to time t2, the all of light emitting units of the pixel group G1 are turned-off first, and then the all of light-emitting units of the pixel group G1 are lighted up sequentially or at the same time after different or same data setup periods.

Similar to the above embodiment of FIG. 9B, during a period from time t0 to time t1, the all of light emitting units of the pixel group G2 are turned-off first, and then the all of light-emitting units of the pixel group G2 are lighted up sequentially or at the same time after different or same data setup periods. During a period from time t1 to time t2, the all light emitting units of the pixel group G1 are lighted up at the same time, and then all light-emitting units of the pixel group G1 are turned-off sequentially or at the same time after different or same emission periods. Therefore, the display device of the embodiment can effective reduce the on-peak power consumption, in particular, can avoid the occurrence of IR-drop and no light if all pixel units are operated in the data setup mode (light emitting units are turned-off).

FIG. 9D is a schematic diagram of signals and dimming operations according to a forth embodiment of the disclosure. Referring to FIG. 9D, the display device of the embodiment includes a pixel array. The pixel array includes a plurality of pixel units, and the plurality of pixel units are respectively operated as the first ramp signal type 601 of the above embodiment of FIG. 6. The plurality of pixel units of the display device of the embodiment can be realized by referring the pixel circuit of the embodiment of FIG. 5. The plurality of pixel units are divided into a plurality of pixel groups for receiving different emission enable signals, and the plurality of pixel groups receive the common ramp signal SS'. In the embodiment of the disclosure, similar to above embodiment of FIG. 9A, the plurality of pixel units are divided into two pixel groups G1 and G2. The pixel groups G1 and G2 may respectively receive the emission enable signals EM1 and EM2. Different from the above embodiment of FIG. 9A, the pixel groups G1 and G2 may respectively receive a common ramp signal SS'. The common ramp signal SS' includes a plurality of sub ramp-up signals.

Similar to the above embodiment of FIG. 9A, during a period from time t0 to time t1, the all of light emitting units of the pixel group G2 are lighted up at the same time, and then all light-emitting units of the pixel group G2 are turned-off sequentially or at the same time after different or same emission periods. During a period from time t1 to time t2, the all of light emitting units of the pixel group G1 are lighted up at the same time, and then all light-emitting units of the pixel group G1 are turned-off sequentially or at the same time after different or same emission periods. Therefore, the display device of the embodiment can effective reduce the on-peak power consumption, in particular, can avoid the occurrence of IR-drop and no light if all pixel units are operated in the data setup mode (light emitting units are turned-off).

Figure 10C:
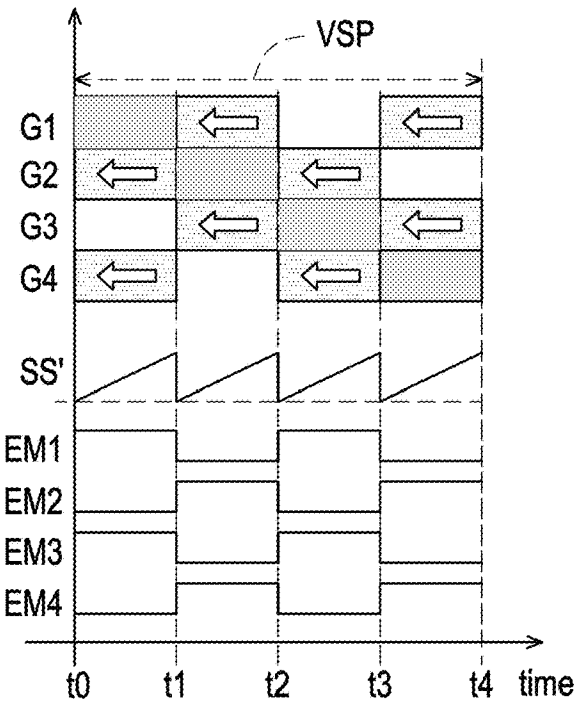
FIG. 10C is a schematic diagram of signals and dimming operations according to a sixth embodiment of the disclosure.
Figure 10B:
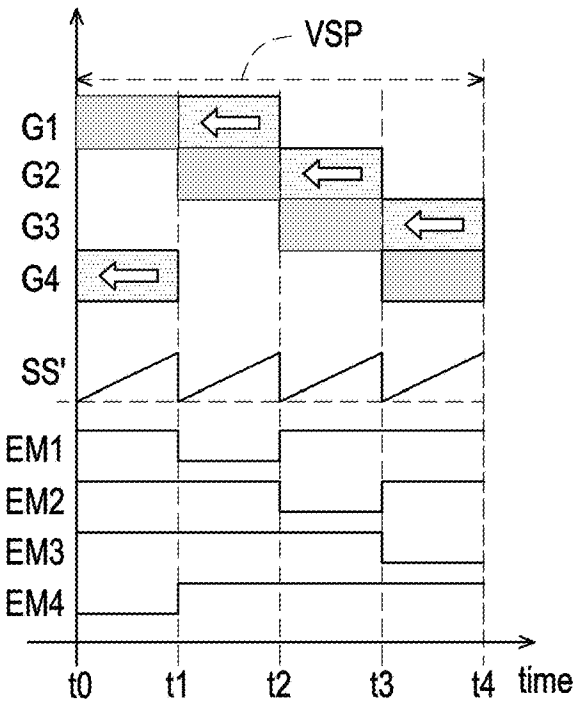
FIG. 10B is a schematic diagram of signals and dimming operations according to a fifth embodiment of the disclosure.
Figure 10A:
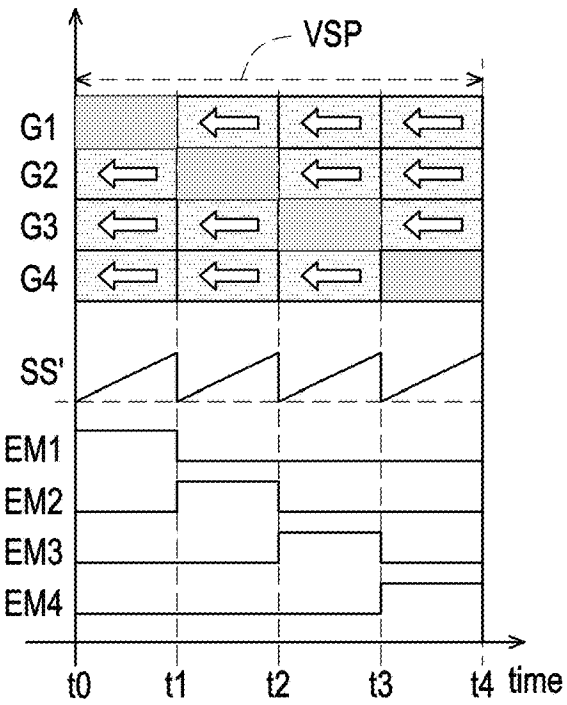
FIG. 10A is a schematic diagram of signals and dimming operations according to a forth embodiment of the disclosure.

FIG. 10A is a schematic diagram of signals and dimming operations according to a forth embodiment of the disclosure. Referring to FIG. 10A, the display device of the embodiment includes a pixel array. The pixel array includes a plurality of pixel units, and the plurality of pixel units are respectively operated as the first ramp signal type 601 of the above embodiment of FIG. 6. The plurality of pixel units of the display device of the embodiment can be realized by referring the pixel circuit of the embodiment of FIG. 5. The plurality of pixel units are divided into a plurality of pixel groups for receiving different emission enable signals, and the plurality of pixel groups receive the common ramp signal SS'. In the embodiment of the disclosure, the plurality of pixel units are divided into four pixel groups G1 to G4.

The pixel groups G1 to G4 may respectively receive the emission enable signals EM1 to EM4, and receive a common ramp signal SS'. The common ramp signal SS' includes a plurality of sub ramp-up signals. During a period from time t0 to time t1, corresponding to the emission enable signal EM1 having the high voltage level (corresponding to the data setup period described in the above embodiment) and the emission enable signals EM2 to EM4 having the low voltage level (corresponding to the enable period described in the above embodiment), the pixel group G1 may be operated in the data setup mode (light emitting units are turned-off), and the pixel groups G2 to G4 may be operated in the dimming mode (light-emitting units are lighted up sequentially or at the same time). The all of light emitting units of the pixel groups G2 to G4 are lighted up at the same time, and then all light-emitting units of the pixel groups G2 to G4 are turned-off sequentially or at the same time after different or same emission periods. During a period from time t1 to time t2, corresponding to the emission enable signal EM2 having the high voltage level (corresponding to the data setup period described in the above embodiment) and the emission enable signals EM1, EM3 and EM4 having the low voltage level (corresponding to the enable period described in the above embodiment), the pixel group G2 may be operated in the data setup mode (light emitting units are turned-off), and the pixel groups G1, G3, and G4 may be operated in the dimming mode (light-emitting units are lighted up sequentially or at the same time). The all of light emitting units of the pixel group G2 are lighted up at the same time, and then all light-emitting units of the pixel group G2 are turned-off sequentially or at the same time after different or same emission periods. During a period from time t2 to time t3, corresponding to the emission enable signal EM3 having the high voltage level (corresponding to the data setup period described in the above embodiment) and the emission enable signals EM1, EM2 and EM4 having the low voltage level (corresponding to the enable period described in the above embodiment), the pixel group G3 may be operated in the data setup mode (light emitting units are turned-off), and the pixel groups G1, G2, and G4 may be operated in the dimming mode (light-emitting units are lighted up sequentially or at the same time). The all of light emitting units of the pixel group G3 are lighted up at the same time, and then all light-emitting units of the pixel group G3 are turned-off sequentially or at the same time after different or same emission periods. During a period from time t3 to time t4, corresponding to the emission enable signal EM4 having the high voltage level (corresponding to the data setup period described in the above embodiment) and the emission enable signals EM1 to EM3 having the low voltage level (corresponding to the enable period described in the above embodiment), the pixel group G4 may be operated in the data setup mode (light emitting units are turned-off), and the pixel groups G1 to G3 may be operated in the dimming mode (light-emitting units are lighted up sequentially or at the same time). The all of light emitting units of the pixel group G4 are lighted up at the same time, and then all light-emitting units of the pixel group G4 are turned-off sequentially or at the same time after different or same emission periods.

It should be noted that, the plurality of ramp periods respectively corresponding to the sub ramp-up signals of the common ramp signal SS' are respectively overlap with the data setup period and emission period of emission enable signals EM1 to EM4. One vertical scan period VSP of display device of the embodiment includes one data setup period and three emission period. The pixel groups G1 to G4 are lighted up during the different emission periods, and setup during different data setup periods according to the emission enable signals EM1 to EM4 respectively. The different data setup periods respectively corresponding to the pixel groups G1 to G4 are non-overlapping with each other in time. Moreover, the data setup period corresponding to one of the emission enable signals EM1 to EM4 overlaps with the emission period corresponding to another three of the emission enable signals EM1 and EM2. Therefore, the display device of the embodiment can effective reduce the on-peak power consumption, in particular, can avoid the occurrence of IR-drop and no light if all pixel units are operated in the data setup mode (light emitting units are turned-off).

FIG. 10B is a schematic diagram of signals and dimming operations according to a fifth embodiment of the disclosure. Referring to FIG. 10B, in the embodiment of the disclosure, the plurality of pixel units are divided into four pixel groups G1 to G4. The pixel groups G1 to G4 may respectively receive the emission enable signals EM1 to EM4, and receive a common ramp signal SS'. The common ramp signal SS' includes a plurality of sub ramp-up signals. Different from the embodiment of FIG. 10A, during a period from time t0 to time t1, corresponding to the emission enable signals EM1 to EM3 having the high voltage level (corresponding to the data setup period described in the above embodiment) and the emission enable signal EM4 having the low voltage level (corresponding to the enable period described in the above embodiment), the pixel group G1 may be operated in the data setup mode (light emitting units are turned-off), and the pixel group G4 may be operated in the dimming mode (light-emitting units are lighted up sequentially or at the same time), wherein the pixel groups G2 and G3 do not receive, for example, the pulse-amplitude modulation scan signal and/or pulse-width modulation scan signal as described in the above embodiment. The pixel groups G2 and G3 may be operated in an idle mode (no operation state). In other word, even the pixel groups G2 and G3 receive the emission enable signals EM2 and EM3 having the high voltage level, if no pulse-amplitude modulation scan signal and/or pulse-width modulation scan signal, the state of the pixel groups G2 and G3 are operated in the idle mode. The all of light emitting units of the pixel group G4 are lighted up at the same time, and then all light-emitting units of the pixel group G4 are turned-off sequentially or at the same time after different or same emission periods. During a period from time t1 to time t2, corresponding to the emission enable signals EM2 to EM4 having the high voltage level (corresponding to the data setup period described in the above embodiment) and the emission enable signal EM1 having the low voltage level (corresponding to the enable period described in the above embodiment), the pixel group G2 may be operated in the data setup mode (light emitting units are turned-off), and the pixel group G1 may be operated in the dimming mode (light-emitting units are lighted up sequentially or at the same time), wherein the pixel groups G3 and G4, for example, do not receive the pulse-amplitude modulation scan signal and/or pulse-width modulation scan signal as described in the above embodiment. The pixel groups G3 and G4 may be operated in the idle mode (no operation state). In other word, even the pixel groups G3 and G4 receive the emission enable signals EM3 and EM4 having the high voltage level, if no pulse-amplitude modulation scan signal and/or pulse-width modulation scan signal, the state of the pixel groups G3 and G4 are operated in the idle mode. The all of light emitting units of the pixel group G1 are lighted up at the same time, and then all light-emitting units of the pixel group G1 are turned-off sequentially or at the same time after different or same emission periods. During a period from time t2 to time t3, corresponding to the emission enable signals EM1, EM3, and EM4 having the high voltage level (corresponding to the data setup period described in the above embodiment) and the emission enable signals EM2 having the low voltage level (corresponding to the enable period described in the above embodiment), the pixel group G3 may be operated in the data setup mode (light emitting units are turned-off), and the pixel group G2 may be operated in the dimming mode (light-emitting units are lighted up sequentially or at the same time), wherein the pixel groups G1 and G4 do not receive, for example, the pulse-amplitude modulation scan signal and/or pulse-width modulation scan signal as described in the above embodiment. The pixel groups G1 and G4 may be operated in the idle mode (no operation state). In other word, even the pixel groups G1 and G4 receive the emission enable signals EM1 and EM4 having the high voltage level, if no pulse-amplitude modulation scan signal and/or pulse-width modulation scan signal, the state of the pixel groups G1 and G4 are operated in the idle mode. The all of light emitting units of the pixel group G2 are lighted up at the same time, and then all light-emitting units of the pixel group G2 are turned-off sequentially or at the same time after different or same emission periods. During a period from time t3 to time t4, corresponding to the emission enable signals EM1, EM2, and EM4 having the high voltage level (corresponding to the data setup period described in the above embodiment) and the emission enable signal EM3 having the low voltage level (corresponding to the enable period described in the above embodiment), the pixel group G4 may be operated in the data setup mode (light emitting units are turned-off), and the pixel group G3 may be operated in the dimming mode (light-emitting units are lighted up sequentially or at the same time), wherein the pixel groups G1 and G2 do not receive, for example, the pulse-amplitude modulation scan signal and/or pulse-width modulation scan signal as described in the above embodiment. The pixel groups G1 and G2 may be operated in the idle mode (no operation state). In other word, even the pixel groups G1 and G2 receive the emission enable signals EM1 and EM2 having the high voltage level, if no pulse-amplitude modulation scan signal and/or pulse-width modulation scan signal, the state of the pixel groups G1 and G2 are operated in the idle mode. The all of light emitting units of the pixel group G3 are lighted up at the same time, and then all light-emitting units of the pixel group G3 are turned-off sequentially or at the same time after different or same emission periods. Therefore, the display device of the embodiment can realize the temporally and spatially 1/4 duty ratio through controlling the emission enable signals EM1 to EM4, so as to more effective reduce the on-peak power consumption, in particular, can avoid the occurrence of IR-drop and no light if all pixel units are operated in the data setup mode (light emitting units are turned-off).

FIG. 10C is a schematic diagram of signals and dimming operations according to a sixth embodiment of the disclosure. Referring to FIG. 10C, in the embodiment of the disclosure, the plurality of pixel units are divided into four pixel groups G1 to G4. The pixel groups G1 to G4 may respectively receive the emission enable signals EM1 to EM4, and receive a common ramp signal SS'. The common ramp signal SS' includes a plurality of sub ramp-up signals. Different from the embodiment of FIG. 10A, during a period from time t0 to time t1, corresponding to the emission enable signals EM1 and EM3 having the high voltage level (corresponding to the data setup period described in the above embodiment) and the emission enable signals EM2 and EM4 having the low voltage level (corresponding to the enable period described in the above embodiment), the pixel group G1 may be operated in the data setup mode (light emitting units are turned-off), and the pixel groups G2 and G4 may be operated in the dimming mode (light-emitting units are lighted up sequentially or at the same time), wherein the pixel group G3 does not receive, for example, the pulse-amplitude modulation scan signal and/or pulse-width modulation scan signal as described in the above embodiment. The pixel group G3 may be operated in an idle mode (no operation state). In other word, even the pixel group G3 receive the emission enable signal EM3 having the high voltage level, if no pulse-amplitude modulation scan signal and/or pulse-width modulation scan signal, the state of the pixel group G3 is operated in the idle mode. The all of light emitting units of the pixel groups G2 and G4 are lighted up at the same time, and then all light-emitting units of the pixel groups G2 and G4 are turned-off sequentially or at the same time after different or same emission periods. During a period from time t1 to time t2, corresponding to the emission enable signals EM2 and EM4 having the high voltage level (corresponding to the data setup period described in the above embodiment) and the emission enable signals EM1 and EM3 having the low voltage level (corresponding to the enable period described in the above embodiment), the pixel group G2 may be operated in the data setup mode (light emitting units are turned-off), and the pixel groups G1 and G3 may be operated in the dimming mode (light-emitting units are lighted up sequentially or at the same time), wherein the pixel group G4 does not receive, for example, the pulse-amplitude modulation scan signal and/or pulse-width modulation scan signal as described in the above embodiment. The pixel group G4 may be operated in an idle mode (no operation state). In other word, even the pixel group G4 receive the emission enable signal EM4 having the high voltage level, if no pulse-amplitude modulation scan signal and/or pulse-width modulation scan signal, the state of the pixel group G4 is operated in the idle mode. The all of light emitting units of the pixel groups G1 and G3 are lighted up at the same time, and then all light-emitting units of the pixel groups G1 and G3 are turned-off sequentially or at the same time after different or same emission periods. During a period from time t2 to time t3, corresponding to the emission enable signals EM1 and EM3 having the high voltage level (corresponding to the data setup period described in the above embodiment) and the emission enable signals EM2 and EM4 having the low voltage level (corresponding to the enable period described in the above embodiment), the pixel group G3 may be operated in the data setup mode (light emitting units are turned-off), and the pixel groups G2 and G4 may be operated in the dimming mode (light-emitting units are lighted up sequentially or at the same time), wherein the pixel group G1 does not receive, for example, the pulse-amplitude modulation scan signal and/or pulse-width modulation scan signal as described in the above embodiment. The pixel group G1 may be operated in an idle mode (no operation state). In other word, even the pixel group G1 receive the emission enable signal EM1 having the high voltage level, if no pulse-amplitude modulation scan signal and/or pulse-width modulation scan signal, the state of the pixel group G1 is operated in the idle mode. The all of light emitting units of the pixel groups G2 and G4 are lighted up at the same time, and then all light-emitting units of the pixel groups G2 and G4 are turned-off sequentially or at the same time after different or same emission periods. During a period from time t3 to time t4, corresponding to the emission enable signals EM2, and EM4 having the high voltage level (corresponding to the data setup period described in the above embodiment) and the emission enable signals EM1 and EM3 having the low voltage level (corresponding to the enable period described in the above embodiment), the pixel group G4 may be operated in the data setup mode (light emitting units are turned-off), and the pixel groups G1 and G3 may be operated in the dimming mode (light-emitting units are lighted up sequentially or at the same time), wherein the pixel group G2 does not receive, for example, the pulse-amplitude modulation scan signal and/or pulse-width modulation scan signal as described in the above embodiment. The pixel group G2 may be operated in an idle mode (no operation state). In other word, even the pixel group G2 receive the emission enable signal EM3 having the high voltage level, if no pulse-amplitude modulation scan signal and/or pulse-width modulation scan signal, the state of the pixel group G2 is operated in the idle mode. The all of light emitting units of the pixel groups G1 and G3 are lighted up at the same time, and then all light-emitting units of the groups G1 and G3 are turned-off sequentially or at the same time after different or same emission periods. Therefore, the display device of the embodiment can realize the temporally and spatially 1/2 duty ratio through controlling the emission enable signals EM1 to EM4, so as to more effective reduce the on-peak power consumption, in particular, can avoid the occurrence of IR-drop and no light if all pixel units are operated in the data setup mode (light emitting units are turned-off).

Figure 11:
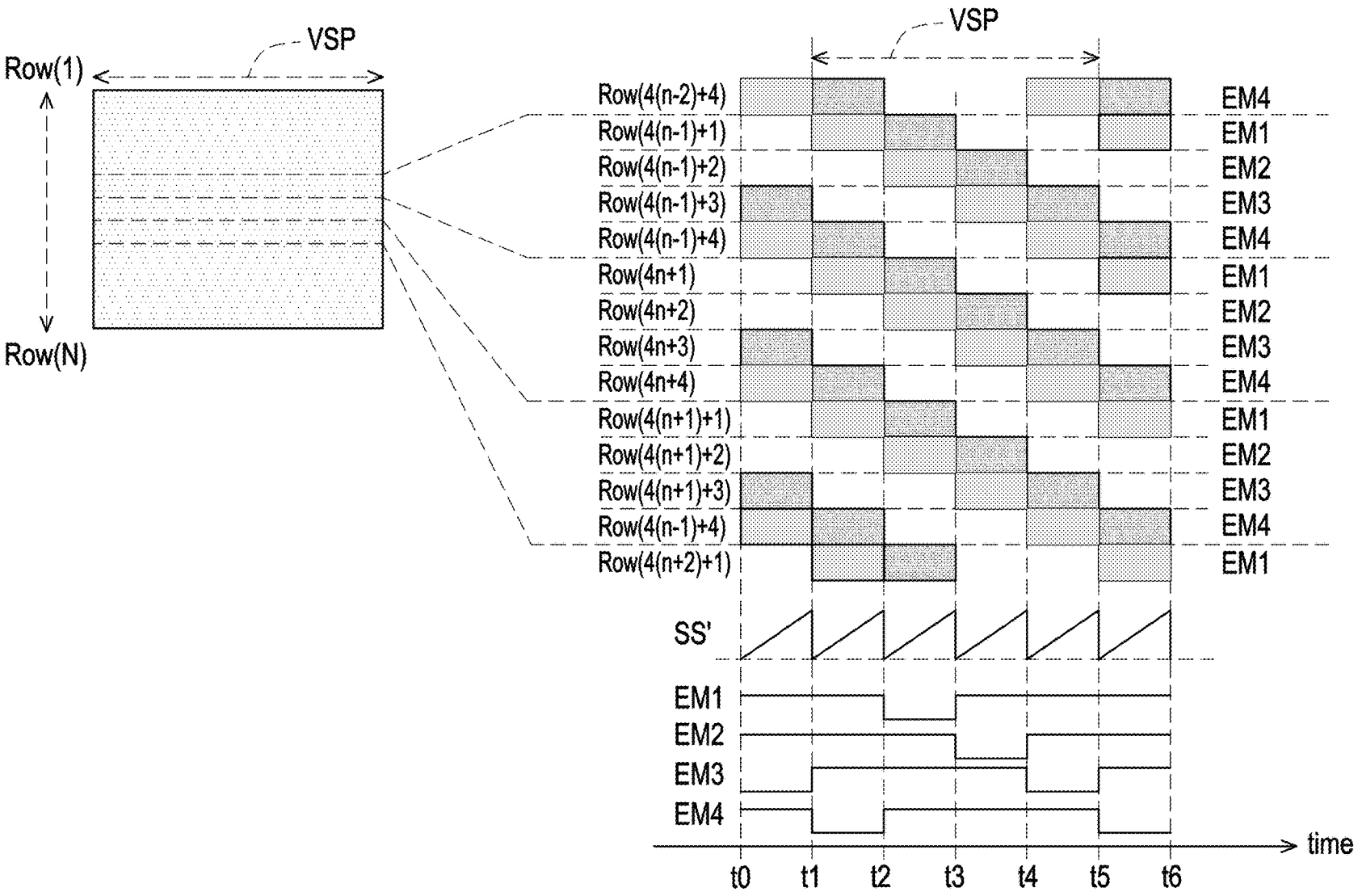
FIG. 11 is a schematic diagram of signals and dimming operations according to a seventh embodiment of the disclosure.

FIG. 11 is a schematic diagram of signals and dimming operations according to a seventh embodiment of the disclosure. Referring to FIG. 11, the display device of the embodiment includes a pixel array. The pixel array includes a plurality of pixel units, and the plurality of pixel units are respectively operated as the first ramp signal type 601 of the above embodiment of FIG. 6. The plurality of pixel units of the display device of the embodiment can be realized by referring the pixel circuit of the embodiment of FIG. 5. The plurality of pixel units are divided into a plurality of pixel groups for receiving different emission enable signals, and the plurality of pixel groups receive the common ramp signal SS'. In the embodiment of the disclosure, the plurality of pixel units are divided into four pixel groups. It should be noted that, the four pixel groups of pixel units respectively correspond to different rows of the pixel array, and the different rows of the pixel array corresponding to the different groups of pixel units are arranged alternately and sequentially. As shown in FIG. 11, the first pixel group includes the row(4(n−1)+1) of the pixel array, the row(4n+1) of the pixel array, the row(4(n+1)+1) of the pixel array, the row(4(n+2)+1) of the pixel array, and so on, wherein the n may be equal to 2 or larger than 2. The second pixel group includes the row(4(n−1)+2) of the pixel array, the row(4n+2) of the pixel array, the row(4(n+1)+2) of the pixel array, and so on. The third pixel group includes the row(4(n−1)+3) of the pixel array, the row(4n+3) of the pixel array, the row(4(n+1)+3) of the pixel array, and so on. The fourth pixel group includes the row(4(n−2)+4) of the pixel array, the row(4(n−1)+4) of the pixel array, the row(4n+4) of the pixel array, the row(4(n+1)+4) of the pixel array, and so on.

The four pixel groups may respectively receive the emission enable signals EM1 to EM4, and receive a common ramp signal SS'. The common ramp signal SS' includes a plurality of sub ramp-up signals. During a period from time t1 to time t2, corresponding to the emission enable signal EM4 having the low voltage level (corresponding to the enable period described in the above embodiment) and the emission enable signals EM1 to EM3 having the high voltage level (corresponding to the data setup period described in the above embodiment), the fourth pixel group may be operated in the dimming mode (light-emitting units are lighted up sequentially or at the same time), and the first pixel group may be operated in the data setup mode (light emitting units are turned-off), wherein the second pixel group and third pixel group may be operated in the idle mode. The all of light emitting units of the fourth pixel group is lighted up at the same time, and then all light-emitting units of the fourth pixel group is turned-off sequentially or at the same time after different or same emission periods. During a period from time t2 to time t3, corresponding to the emission enable signal EM1 having the low voltage level (corresponding to the enable period described in the above embodiment) and the emission enable signals EM2 to EM4 having the high voltage level (corresponding to the data setup period described in the above embodiment), the first pixel group may be operated in the dimming mode (light-emitting units are lighted up sequentially or at the same time), and the second pixel group may be operated in the data setup mode (light emitting units are turned-off), wherein the third pixel group and fourth pixel group may be operated in the idle mode. The all of light emitting units of the first pixel group is lighted up at the same time, and then all light-emitting units of the first pixel group is turned-off sequentially or at the same time after different or same emission periods. During a period from time t3 to time t4, corresponding to the emission enable signal EM2 having the low voltage level (corresponding to the enable period described in the above embodiment) and the emission enable signals EM1, EM3 and EM4 having the high voltage level (corresponding to the data setup period described in the above embodiment), the second pixel group may be operated in the dimming mode (light-emitting units are lighted up sequentially or at the same time), and the third pixel group may be operated in the data setup mode (light emitting units are turned-off), wherein the first pixel group and fourth pixel group may be operated in the idle mode. The all of light emitting units of the second pixel group is lighted up at the same time, and then all light-emitting units of the second pixel group is turned-off sequentially or at the same time after different or same emission periods. During a period from time t4 to time t5, corresponding to the emission enable signal EM3 having the low voltage level (corresponding to the enable period described in the above embodiment) and the emission enable signals EM1, EM2, and EM4 having the high voltage level (corresponding to the data setup period described in the above embodiment), the third pixel group may be operated in the dimming mode (light-emitting units are lighted up sequentially or at the same time), and the fourth pixel group may be operated in the data setup mode (light emitting units are turned-off), wherein the first pixel group and second pixel group may be operated in the idle mode. The all of light emitting units of the third pixel group is lighted up at the same time, and then all light-emitting units of the third pixel group is turned-off sequentially or at the same time after different or same emission periods. During one vertical scan period VSP of display device, each row of pixel array performs one emission operation during one emission period, and performs one data setup operation during one data setup period. Therefore, the display device of the embodiment can realize the temporally and spatially 1/4 duty ratio through controlling the emission enable signals EM1 to EM4 based on the interlace emission manner of the embodiment, so as to more effective reduce the on-peak power consumption, in particular, can avoid the occurrence of IR-drop and no light if all pixel units are operated in the data setup mode (light emitting units are turned-off).

Figure 12:
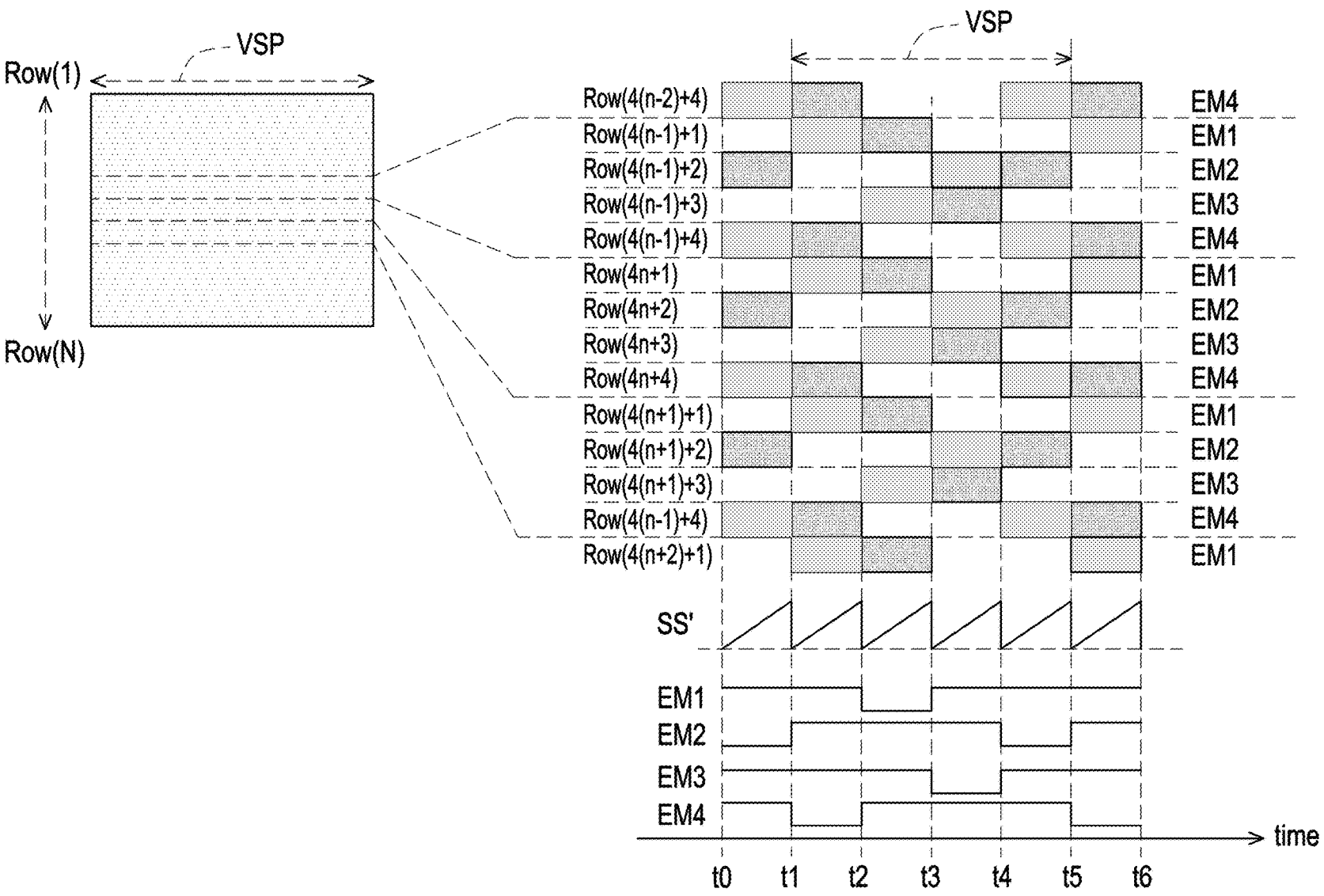
FIG. 12 is a schematic diagram of signals and dimming operations according to an eighth embodiment of the disclosure.

FIG. 12 is a schematic diagram of signals and dimming operations according to an eighth embodiment of the disclosure. Referring to FIG. 12, the display device of the embodiment includes a pixel array. The pixel array includes a plurality of pixel units, and the plurality of pixel units are respectively operated as the first ramp signal type 601 of the above embodiment of FIG. 6. The plurality of pixel units of the display device of the embodiment can be realized by referring the pixel circuit of the embodiment of FIG. 5. The plurality of pixel units are divided into a plurality of pixel groups for receiving different emission enable signals, and the plurality of pixel groups receive the common ramp signal SS'. In the embodiment of the disclosure, the plurality of pixel units are divided into four pixel groups. It should be noted that, the four pixel groups of pixel units respectively correspond to different rows of the pixel array, and the different rows of the pixel array corresponding to the different groups of pixel units are arranged alternately but non-sequentially.

In the embodiment of the disclosure, the four pixel groups may respectively receive the emission enable signals EM1 to EM4, and receive a common ramp signal SS'. The common ramp signal SS' includes a plurality of sub ramp-up signals. Different from the embodiment of FIG. 11, during a period from time t1 to time t2, corresponding to the emission enable signal EM4 having the low voltage level (corresponding to the enable period described in the above embodiment) and the emission enable signals EM1 to EM3 having the high voltage level (corresponding to the data setup period described in the above embodiment), the fourth pixel group may be operated in the dimming mode (light-emitting units are lighted up sequentially or at the same time), and the first pixel group may be operated in the data setup mode (light emitting units are turned-off), wherein the second pixel group and third pixel group may be operated in the idle mode. The all of light emitting units of the fourth pixel group is lighted up at the same time, and then all light-emitting units of the fourth pixel group is turned-off sequentially or at the same time after different or same emission periods. During a period from time t2 to time t3, corresponding to the emission enable signal EM1 having the low voltage level (corresponding to the enable period described in the above embodiment) and the emission enable signals EM2 to EM4 having the high voltage level (corresponding to the data setup period described in the above embodiment), the first pixel group may be operated in the dimming mode (light-emitting units are lighted up sequentially or at the same time), and the third pixel group may be operated in the data setup mode (light emitting units are turned-off), wherein the second pixel group and fourth pixel group may be operated in the idle mode. The all of light emitting units of the first pixel group is lighted up at the same time, and then all light-emitting units of the first pixel group is turned-off sequentially or at the same time after different or same emission periods. During a period from time t3 to time t4, corresponding to the emission enable signal EM3 having the low voltage level (corresponding to the enable period described in the above embodiment) and the emission enable signals EM1, EM2 and EM4 having the high voltage level (corresponding to the data setup period described in the above embodiment), the third pixel group may be operated in the dimming mode (light-emitting units are lighted up sequentially or at the same time), and the second pixel group may be operated in the data setup mode (light emitting units are turned-off), wherein the first pixel group and fourth pixel group may be operated in the idle mode. The all of light emitting units of the third pixel group is lighted up at the same time, and then all light-emitting units of the third pixel group is turned-off sequentially or at the same time after different or same emission periods. During a period from time t4 to time t5, corresponding to the emission enable signal EM2 having the low voltage level (corresponding to the enable period described in the above embodiment) and the emission enable signals EM1, EM3, and EM4 having the high voltage level (corresponding to the data setup period described in the above embodiment), the second pixel group may be operated in the dimming mode (light-emitting units are lighted up sequentially or at the same time), and the fourth pixel group may be operated in the data setup mode (light emitting units are turned-off), wherein the first pixel group and third pixel group may be operated in the idle mode. The all of light emitting units of the second pixel group is lighted up at the same time, and then all light-emitting units of the second pixel group is turned-off sequentially or at the same time after different or same emission periods. During one vertical scan period VSP of display device, each row of pixel array performs one emission operation during one emission period, and performs one data setup operation during one data setup period. Therefore, the display device of the embodiment can realize the temporally and spatially 1/4 duty ratio through controlling the emission enable signals EM1 to EM4 based on the skip emission manner of the embodiment, so as to more effective reduce the on-peak power consumption, in particular, can avoid the occurrence of IR-drop and no light if all pixel units are operated in the data setup mode (light emitting units are turned-off).

Figure 13:
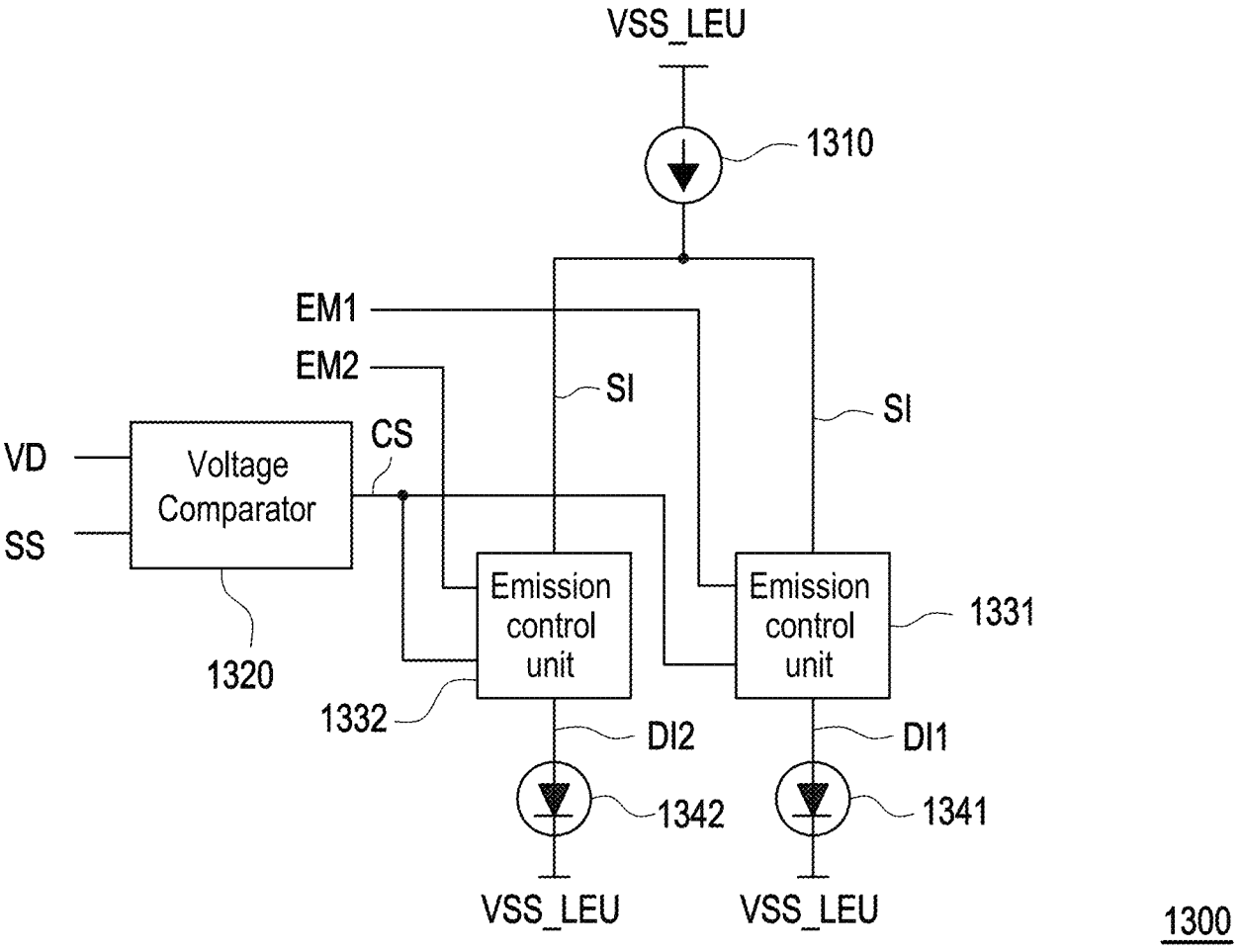
FIG. 13 is a schematic diagram of a display device according to yet another again embodiment of the disclosure.

FIG. 13 is a schematic diagram of a display device according to yet another again embodiment of the disclosure. Referring to FIG. 13, the display device 1300 includes a pixel array, and the pixel array includes a plurality of pixel units, wherein each of the plurality of pixel units may include the circuit architecture as shown in FIG. 13. In the embodiment of the disclosure, the display device 1300 includes a current source 1310, a voltage comparator 1320, an emission control unit 1331, an emission control unit 1332, a light emitting unit 1341, and a light emitting unit 1342. The current source 1310 is coupled to the pixel array and configured to output a supply current SI to the light emitting unit 1341 and the light emitting unit 1342 in the pixel array. Similar to the above embodiments, the current source 1310 may receive a pulse-amplitude modulation scan signal for voltage programming.

The current source 1310 is coupled between an operation voltage VDD_LEU and the emission control unit 1331, and coupled between the operation voltage VDD_LEU and the emission control unit 1332. The emission control unit 1331 is further coupled to the voltage comparator 1320 and the light emitting unit 1341, and receives an emission enable signal EM1. The emission control unit 1332 is further coupled to the voltage comparator 1320 and the light emitting unit 1342, and receives an emission enable signal EM2. The light emitting unit 1341 is coupled between the emission control unit 1331 and the voltage VSS_LEU. The voltage VSS_LEU is lower than the operation voltage VDD_LEU. The light emitting unit 1342 is coupled between the emission control unit 1332 and the voltage VSS_LEU. In other words, the plurality of pixel units may be divided in a plurality of pixel groups, and the pixel groups are coupled to the common current source 1310 and the common voltage comparator 1320.

In the embodiment of the disclosure, the current source 1310 is configured to output a supply current SI to the emission control unit 1331 and the emission control unit 1332. The voltage comparator 1320 is configured to receive a voltage data VD and a ramp signal SS. The voltage comparator 1320 outputs a comparison signal CS to the emission control unit 1331 and the emission control unit 1332 according to the voltage data VD and the ramp signal SS. The emission control unit 1331 may outputs a driving currents DI1 to the light emitting unit 1341 according to the supply current SI, the emission enable signal EM1, and the comparison signal CS. The emission control unit 1332 may outputs a driving currents DI2 to the light emitting unit 1342 according to the supply current SI, the emission enable signal EM2, and the comparison signal CS. In the embodiment of the disclosure, the emission enable signal EM1, the emission enable signal EM2, the voltage data VD, and the ramp signal SS may be provided from multiple driving circuits respectively arranged out of a plane of the display device 1300 or arranged inside the plane of the display device 1300 through a data line and/or a scan line.

It should be noted that, for example, each one of the odd rows in the pixel array in the embodiments of FIG. 11 and FIG. 12 may realized by the emission control unit 1331 and the light emitting unit 1341, and each one of the even rows adjacent to corresponding one odd row in the pixel array in the embodiments of FIG. 11 and FIG. 12 may realized by the emission control unit 1332 and the light emitting unit 1342. In other words, due to the light emitting unit of the each one of the odd rows and the light emitting unit of the each one of the even rows adjacent to corresponding one odd row share the current source 1310 and the voltage comparator 1320, therefore the display device of the embodiments of FIG. 11 and FIG. 12 are capable of reducing the circuit area by time-sharing the circuit with pixels on even and odd rows.

In summary, the display device of one embodiments of the disclosure is capable of reducing the on-peak power consumption by time-sharing for the data setup operation and the dimming operation on different pixel groups of pixel array of the display device, in particular, can avoid the occurrence of IR-drop and no light if all pixel units are operated in the data setup operation. Moreover, the display device of another one embodiments of the disclosure can reduce the circuit area by time-sharing the circuit with pixels on even and odd rows.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device, comprising:

a light emitting unit;

a current source, configured to output a supply current;

a voltage comparator, configured to receive a voltage data and a ramp signal; and an emission control unit, configured to receive an emission enable signal, and coupled to the light emitting unit, the current source, and the voltage comparator;

wherein the voltage comparator outputs a comparison signal to the emission control unit according to the voltage data and the ramp signal, and the emission control unit outputs a driving current to the light emitting unit according to the supply current, the emission enable signal, and the comparison signal.

2. The display device according to claim 1, wherein a time length of an emission period of the driving current is determined by the voltage data and the ramp signal.

3. The display device according to claim 1, wherein the voltage comparator further receives a pulse-width modulation scan signal, and performs voltage programming on the voltage data according to the pulse-width modulation scan signal.

4. The display device according to claim 1, wherein the voltage comparator comprises:

a first transistor, wherein a first terminal of the first transistor is coupled to a data line and receives the voltage data, and a control terminal of the first transistor receives the pulse-width modulation scan signal;

a second transistor, wherein a first terminal of the second transistor receives the ramp signal, a control terminal of the second transistor receives the emission enable signal, and a second terminal of the second transistor is coupled to a second terminal of the first transistor;

a first capacitor, wherein a first terminal of the first capacitor is coupled to the second terminal of the second transistor and the second terminal of the first transistor;

a first inverter circuit, wherein an input terminal of the first inverter circuit is coupled to a second terminal of the first capacitor, and an output terminal of the first inverter circuit is coupled to the emission control unit; and a third transistor, wherein a first terminal of the third transistor is coupled to the input terminal of the first inverter circuit, a control terminal of the third transistor receives the pulse-width modulation scan signal, and a second terminal of the third transistor is coupled to the output terminal of the first inverter circuit.

5. The display device according to claim 4, wherein the first inverter circuit comprises:

a fourth transistor, wherein a first terminal of the fourth transistor receives an operation voltage, a control terminal of the fourth transistor is coupled to the input terminal of the first inverter circuit, and a second terminal of the fourth transistor is coupled to the output terminal of the first inverter circuit; and a fifth transistor, wherein a first terminal of the fifth transistor receives a voltage, a control terminal of the fifth transistor is coupled to the input terminal of the first inverter circuit, and a second terminal of the fifth transistor is coupled to the output terminal of the first inverter circuit.

6. The display device according to claim 4, wherein the voltage comparator further comprises:

a second inverter circuit, wherein an input terminal of the second inverter circuit is coupled to the output terminal of the first inverter circuit, and an output terminal of the second inverter circuit is coupled to the emission control unit.

7. The display device according to claim 1, wherein the emission control unit comprises:

a sixth transistor, wherein a control terminal of the sixth transistor is coupled to the voltage comparator;

a seventh transistor, wherein a first terminal of the seventh transistor is coupled to an operation voltage, a control terminal of the seventh transistor receives the emission enable signal, and a second terminal of the seventh transistor is coupled to a first terminal of the sixth transistor;

an eighth transistor, wherein a first terminal of the eighth transistor is couple to a second terminal of the sixth transistor, a control terminal of the eighth transistor is coupled to the voltage comparator, and a second terminal of the eighth transistor is coupled to a voltage;

a ninth transistor, wherein a first terminal of the ninth transistor is coupled to the second terminal of the sixth transistor, a control terminal of the ninth transistor receives the emission enable signal, and a second terminal of the ninth transistor is coupled to the voltage; and a tenth transistor, wherein a first terminal of the tenth transistor is coupled to the current source, a control terminal of the tenth transistor is coupled to the second terminal of the sixth transistor, and a second terminal of the tenth transistor is coupled to the light emitting unit.

8. The display device according to claim 1, wherein the current source further receives a pulse-amplitude modulation scan signal for voltage programming.

9. The display device according to claim 8, wherein the current source comprises:

an eleventh transistor, wherein a first terminal of the eleventh transistor is coupled to a data line and receives the voltage data, and a control terminal of the eleventh transistor receives the pulse-amplitude modulation scan signal;

a twelfth transistor, wherein a first terminal of the twelfth transistor receives an operation voltage, a control terminal of the twelfth transistor is coupled to a second terminal of the eleventh transistor, and a second terminal of the twelfth transistor is coupled to the emission control unit; and a second capacitor, wherein a first terminal of the second capacitor is coupled to the second terminal of the eleventh transistor, and a second terminal of the second capacitor is coupled to the second terminal of the twelfth transistor.

10. The display device according to claim 8, wherein the current source comprises:

a thirteenth transistor, wherein a first terminal of the thirteenth transistor is coupled to a data line and receives the voltage data, and a control terminal of the thirteenth transistor receives the pulse-amplitude modulation scan signal;

a fourteenth transistor, wherein a first terminal of the fourteenth transistor receives an operation voltage, a control terminal of the fourteenth transistor receives an emission enable signal, and a second terminal of the fourteenth transistor is couple to a second terminal of the thirteenth transistor;

a fifteenth transistor, wherein a first terminal of the fifteenth transistor is couple to the second terminal of the fourteenth transistor, and a second terminal of the fifteenth transistor is coupled to the emission control unit;

a third capacitor, wherein a first terminal of the third capacitor is coupled to the first terminal of the fourteenth transistor, and a second terminal of the third capacitor is coupled to a control terminal of the fifteenth transistor;

a sixteenth transistor, wherein a first terminal of the sixteenth transistor is coupled to the second terminal of the fifteenth transistor, a control terminal of the sixteenth transistor receives the pulse-amplitude modulation scan signal, and a second terminal of the sixteenth transistor is coupled to the control terminal of the fifteenth transistor; and a seventeenth transistor, wherein a first terminal of the seventeenth transistor is coupled to the second terminal of the sixteenth transistor, a control terminal of the seventeenth transistor receives a pulse-width modulation scan signal, and a second terminal of the seventeenth transistor is coupled to a reset voltage.

11. The display device according to claim 8, wherein the current source comprises:

an eighteenth transistor, wherein a first terminal of the eighteenth transistor is coupled to a data line and receives the voltage data, and a control terminal of the eighteenth transistor receives the pulse-amplitude modulation scan signal;

a nineteenth transistor, wherein a first terminal of the nineteenth transistor is coupled to a second terminal of the eighteenth transistor, a control terminal of the nineteenth transistor receives an emission enable signal, and a second terminal of the nineteenth transistor is coupled to a reference voltage;

a twentieth transistor, wherein a first terminal of the twentieth transistor is coupled to the second terminal of the eighteenth transistor, a control terminal of the twentieth transistor receives a pulse-width modulation scan signal, and a second terminal of the twentieth transistor is coupled to the reference voltage;

a fourth capacitor, wherein a first terminal of the fourth capacitor is coupled to the second terminal of the eighteenth transistor;

a fifth capacitor, wherein a first terminal of the fifth capacitor is coupled to the second terminal of the fourth capacitor, and a second terminal of the fifth capacitor receives an operation voltage;

a twenty-first transistor, wherein a first terminal of the twenty-first transistor is coupled to the second terminal of the fifth capacitor and the operation voltage, a control terminal of the twenty-first transistor is coupled to the first terminal of the fifth capacitor;

a twenty-second transistor, wherein a first terminal of the twenty-second transistor is coupled to the first terminal of the fifth capacitor, a control terminal of the twenty-second transistor receives the pulse-amplitude modulation scan signal, and a second terminal of the twenty-second transistor is coupled to a second terminal of the twenty-first transistor; and a twenty-third transistor, wherein a first terminal of the twenty-third transistor is coupled to the first terminal of the fifth capacitor, a control terminal of the twenty-third transistor receives the pulse-width modulation scan signal, and a second terminal of the twenty-third transistor is coupled to a reset voltage.

12. The display device according to claim 1, wherein the ramp signal is a ramp-up signal or a ramp-down signal.

13. A display device, comprising:

a pixel array, comprising a plurality of pixel units, wherein the plurality of pixel units are divided into a plurality of pixel groups, and each of the plurality of pixel units comprises:

multiple light emitting units;

a voltage comparator; and multiple emission control units, coupled to the light emitting units and the voltage comparator;

wherein the plurality of pixel groups respectively receive a plurality of emission enable signals via the emission control units, and receive a plurality of voltage data and a common ramp signal via the voltage comparator, wherein the light emitting units corresponding to the plurality of pixel groups are lighted up during a plurality of emission periods and set up during a plurality of data setup periods according to the plurality of emission enable signals, the plurality of voltage data, and the common ramp signal, respectively, wherein the plurality of data setup periods respectively corresponding to the plurality of pixel groups are non-overlapping with each other in time.

14. The display device according to claim 13, wherein the data setup period corresponding to one of the emission enable signals overlaps with the emission period corresponding to at least another one of the emission enable signals.

15. The display device according to claim 13, wherein the common ramp signal comprises a plurality of sub ramp signals, wherein a plurality of ramp periods respectively corresponding to the sub ramp signals are respectively overlap with the data setup period and emission period of one emission enable signal.

16. The display device according to claim 13, wherein the pixel groups respectively correspond to different rows of the pixel array, and the different rows of the pixel array corresponding to the different pixel groups are arranged alternately and sequentially.

17. The display device according to claim 13, wherein different rows of the pixel array corresponding to the different pixel groups are arranged alternately but non-sequentially.

18. The display device according to claim 13, further comprising:

a current source, coupled to the pixel array, and configured to output a supply current to the pixel array, wherein the current source receives a pulse-amplitude modulation scan signal for voltage programming.

19. The display device according to claim 13, wherein when the light emitting units corresponding to the plurality of pixel groups are lighted up during the plurality of emission periods, the plurality of pixel groups respectively receive a pulse-width modulation scan signal via the voltage comparator.

20. The display device according to claim 13, wherein the pixel groups are coupled to a common current source and the voltage comparator.

* * * * *